US006207624B1

(12) United States Patent
Stachew et al.

(10) Patent No.: US 6,207,624 B1
(45) Date of Patent: Mar. 27, 2001

(54) ENGINE OIL HAVING DISPERSANT AND ALDEHYDE/EPOXIDE FOR IMPROVED SEAL PERFORMANCE, SLUDGE AND DEPOSIT PERFORMANCE

(75) Inventors: Carl F. Stachew, Wickliffe; William D. Abraham, South Euclid; James A. Supp, Parma; James R. Shanklin, Concord; Gordon David Lamb, Shaker Heights, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/616,202

(22) Filed: Jul. 13, 2000

Related U.S. Application Data

(63) Continuation of application No. 09/118,279, filed on Jul. 17, 1998, now abandoned.

(51) Int. Cl.[7] ..... C10M 141/02; C10M 141/06

(52) U.S. Cl. ..... 508/290; 508/291; 508/304; 508/577; 508/578; 508/579

(58) Field of Search ..... 508/290, 297, 508/304, 578, 577, 579

(56) References Cited

U.S. PATENT DOCUMENTS

| | | | |
|---|---|---|---|
| 2,145,977 | 2/1939 | Cantrell et al. | 508/378 |
| 2,900,342 | 8/1959 | Manteuffel et al. | 508/304 |
| 3,005,778 | 10/1961 | Sweetman | 508/378 |
| 3,298,951 | 1/1967 | Guminski et al. | 508/378 |
| 3,658,637 | 4/1972 | Danielson | 161/231 |
| 4,076,642 | 2/1978 | Herber et al. | 252/78.5 |
| 4,244,829 | 1/1981 | Coupland | 508/304 |
| 4,636,322 | 1/1987 | Nalesnik | 252/51.5 A |
| 4,661,120 | 4/1987 | Carr et al. | 44/57 |
| 4,663,064 | 5/1987 | Nalesnik et al. | 252/51.5 A |
| 4,699,724 | 10/1987 | Nalesnik et al. | 252/51.5 A |
| 4,713,189 | 12/1987 | Nalesnik et al. | 252/51.5 A |
| 4,713,191 | 12/1987 | Nalesnik | 252/51.5 A |
| 4,873,004 | 10/1989 | Bevervikj et al. | 508/290 |
| 5,211,835 | 5/1993 | Forester | 208/48 AA |
| 5,320,765 | 6/1994 | Fetterman et al. | 508/290 |
| 5,370,809 | 12/1994 | Ishida et al. | 508/304 |
| 5,454,963 * | 10/1995 | Kaneko . | |
| 6,121,211 * | 9/2000 | Stachen et al. | 508/304 |

FOREIGN PATENT DOCUMENTS

| | | |
|---|---|---|
| 330 522 | 8/1989 | (EP) . |
| 355 895 | 2/1990 | (EP) . |
| 582 451 | 8/1992 | (EP) . |
| 612 835 | 8/1994 | (EP) . |

* cited by examiner

*Primary Examiner*—Margaret Medley
(74) *Attorney, Agent, or Firm*—David M. Shold

(57) ABSTRACT

Disclosed is a lubricating composition having a major amount of an oil of lubrication viscosity and a minor amount of (A) a nitrogen containing dispersant with a total base number of from 20 to 160 on an oil-free basis wherein the improvement comprises adding to said dispersant; (B) a sludge preventing/seal protecting additive of at least one aldehyde or epoxide or mixtures thereof.

27 Claims, No Drawings

ENGINE OIL HAVING DISPERSANT AND ALDEHYDE/EPOXIDE FOR IMPROVED SEAL PERFORMANCE, SLUDGE AND DEPOSIT PERFORMANCE

This is a continuation of application Ser. No. 09/118,279 filed Jul. 17, 1998, now abandoned.

FIELD OF THE INVENTION

Internal combustion engines operate under a wide range of temperatures including low temperature stop and go service as well as high temperature conditions produced by continuous high speed driving. Stop and go driving, particularly during cold, damp weather conditions, leads to formation of a sludge in the crankcase and in the oil passages of a gasoline or a diesel engine. This sludge seriously limits the ability of the crankcase oil to lubricate the engine effectively. In addition, the sludge with its entrapped water tends to contribute to rust formation in the engine. These problems tend to be aggravated by the manufacture's lubrication service recommendations which specify extended drain oils.

Another problem facing the lubricant manufacturer is that of seal deterioration in the engine. All internal combustion engines use elastomer seals, such as viton seals, in their assembly. Over time, these seal are susceptible to serious deterioration caused by the lubricating oil composition and the deterioration results in oil leaking from the engine. A lubricating oil composition that degrades the elastomer seals in an engine is unacceptable to engine manufacturers and has limited value.

BACKGROUND OF THE INVENTION

It is known to employ nitrogen containing dispersants and/or detergents in the formation of crankcase lubricating oil compositions. Many of the known dispersant/detergent compounds are based on the reaction of an alkenylsuccinic acid or anhydride with an amine or polyamine to produce an alkylsuccinimide or an alkenylsuccinimic acid as determined by selected conditions of reaction.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

U.S. Pat. No. 4,636,322 (Nalesnik, Jan. 13, 1987) provides an additive which improves the dispersancy and viton seal compatibility of a lubricating oil. The lubricating oil composition comprises a major portion of a lubricating oil and a minor dispersant amount of a reaction product prepared by the process which comprises:

(a) reacting a polyethylene amine with an alkenyl succinic acid anhydride to form a bis-alkenyl succinimide;

(b) acylating said bis-alkenyl-succinimide with glycolic acid to form a partially glycolated bis-alkenyl succinimide;

(c) adding an excess of a formaldehyde to said partially glycolated bis-alkenyl succinimide to form an iminium salt of the glycolated bis-alkenyl succinimide;

(d) adding a phenol to said iminium salt, thereby forming an acylated Mannich phenol coupled glycamide bis-alkenyl succinimide; and (e) recovering said acylated Mannich phenol coupled glycamide bis-alkenyl succinimide.

U.S. Pat. No. 4,663,064 Nalesnik et al., May 5, 1987) provides a novel additive which improves the dispersancy and viton seal compatibility of a lubricating oil. The lubricating oil composition comprises a major portion of a lubricating oil and a minor dispersant amount of a reaction product prepared by the process which (a) reacting a polyethylene amine with an alkenyl succinic acid anhydride to form a bis-alkenyl succinimide;

(b) acylating said bis-alkenyl-succinimide with glycolic acid to form a partially glycolated bis-alkenyl succinimide;

(c) adding a diacid to said glycolated bis-alkenyl succininide, thereby forming an acylated diacid coupled glycamide bis-alkenyl succinimide; and (d) recovering said acylated diacid coupled glycamide bis-alkenyl succinimide.

U.S. Pat. No. 4,699,724 Nalesnik et al., Oct. 13, 1987) relates to an additive which improves the dispersancy and viton seal compatibility of a lubricating oil. The lubricating oil composition comprises a major portion of a lubricating oil and a minor dispersant amount of a reaction product comprising:

(a) reacting a polyethylene amine with an alkenyl succinic acid anhydride to form a mono-alkenyl succinimide;

(b) adding an excess of a formaldehyde to the monoalkenyl succinimide to form an imine of the monoalkenyl succinimide;

(c) adding a phenol to the imine, thereby forming a Mannich phenol coupled mono-alkenyl succinimide;

(d) acylating the coupled mono-alkenyl succinimide with glycolic acid to form a glycolated, Mannich phenol coupled mono-alkenyl succinimide; and (e) recovering the acylated, Mannich phenol coupled mono-alkenyl succinimide.

U.S. Pat. No. 4,713,189 (Nalesnik et al., Dec. 15, 1987) provides a novel additive which improves the dispersancy and viton seal compatibility of a lubricating oil. The lubricating oil composition comprises a major portion of a lubricating oil and a minor dispersant amount of a reaction product comprising:

(a) reacting a polyethyleamine with a phenolic compound in the presence of excess formaldehyde to give a Mannich coupled polyethyleneamine;

(b) reacting the Mannich coupled polyethyleneamine with an alkenyl succinic acid anhydride to form a Mannich coupled mono-alkenyl succinimide;

(c) acylating the coupled mono-alkenyl succinimide with glycolic acid to form a glycolated, Mannich coupled mono-alkenyl succinimide; and (d) recovering the glycolated, Mannich coupled mono-alkenyl succinimide.

U.S. Pat. No. 4,713,191 (Nalesnik, Dec. 15, 1987) provides an additive which improves the dispersancy of a lubricating oil. The lubricating oil composition comprises a major portion of a lubricating oil and a minor dispersant amount of a reaction product prepared by the process which comprises:

(a) reacting a polyethylene amine with an alkenyl succinic acid anhydride to form a bis-alkenyl succinimide;

(b) acylating said bis-alkenyl-succinimide with glycolic acid to form a partially glycolated bisalkenyl succinimide;

(c) adding an organic diisocyanate to said glycolated bis-alkenyl succinimide, thereby forming a diurea coupled glycamide bis-alkenyl succinimide; and (d) recovering said diurea coupled glycamide bisalkenyl succinimide.

U.S. Pat. No. 5,211,835 (Forester, May 18, 1993) pertains to the use of reaction products of partially glycolated polyalkenyl succinimides and diisocyanates to inhibit fouling in liquid hydrocarbon mediums during the heat treatment processing of the medium, such as in refinery processes.

The reaction products are formed via a three-step reaction. In the first step, a polyalkenyl succinic anhydride is reacted with an amine, preferably a polyamine, such as a polyethyleneamine, in order to form a polyalkenylsuccinimide intermediate. The intermediate is then reacted with enough glycolic acid to acylate all of the free basic amines except for one or one equivalent amine to form a partially glycolated bis-alkenyl succinimide. A diisocyanate is then added to the succinimide to form the desired reaction product.

SUMMARY OF THE INVENTION

A lubricating composition is disclosed which has a major amount of an oil of lubrication viscosity and a minor amount of (A) a nitrogen containing dispersant with a total base number of from 20 to 160 wherein the improvement comprises adding to said dispersant;

(B) a sludge preventing/seal protecting additive of at least one aldehyde or epoxide or mixtures thereof.

DETAILED DESCRIPTION OF THE INVENTION

Oil of Lubrication Viscosity

The diverse oils of lubricating viscosity include natural and synthetic lubricating oils and mixtures thereof These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-bexenes, poly(1-octenes), poly(1-decenes), etc. and mixtures thereof]; alkylbenzenes [e.g., dodecylbenzenes, tetradecylbenzenes, dinonylbenzenes, di(2-ethyithexyl)-benzenes, etc.]; polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1,000 diphenyl ether of polyethylene glycol having a molecular weight of 500–1,000, diethyl ether of polypropylene glycol having a molecular weight of 1,000–1,500, etc.) or mono- and polycarboxylic esters thereof, for example, the acetic acid esters, mixed $C_3$-$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to C12 monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy)-disiloxane, poly(methyl) siloxanes, poly (methylphenyl) siloxanes, etc.). Other synthetic lubricating oils include liquid esters of phosphorus-containing acids (e.g., tricresyl phosphate, trioctyl phosphate, diethyl ester of decane phosphonic acid, etc.) polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such a solvent extraction, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

The aliphatic and alicyclic substituents, as well as aryl nuclei, are generally described as "hydrocarbon-based". The meaning of the term "hydrocarbon-based" as used herein is apparent from the following detailed discussion of "hydrocarbon-based substituent."

As used herein, the term "hydrocarbon-based substituent" denotes a substituent having a carbon atom directly attached to the remainder of the molecule and having predominantly hydrocarbyl character within the context of this invention. Such substituents include the following:

(1) Hydrocarbon substituents, that is aliphatic (e.g., alkyl or alkenyl), alicyclic (e.g., cycloalkyl or cycloalkenyl) substituents, aromatic, aliphatic- and alicyclic-substituted aromatic nuclei and the like, as well as cyclic substituents wherein a ring is completed through another portion of the molecule.

(2) Substituted hydrocarbon substituents, that is, those containing non-hydrocarbon radicals which, in the context of this invention, do not alter the predominantly hydrocarbyl character of the substituent. Those skilled in the art will be aware of suitable radicals (e.g., hydroxy, halo, (especially chloro and fluoro), alkoxyl, mercapto, alkyl mercapto, nitro, nitroso, sulfoxy, etc., radicals).

(3) Hetero substituents, that is, substituents which, while predominantly hydrocarbon in character within the context of this invention, contain atoms other than carbon present in a chain or ring otherwise composed of carbon atoms. Suitable hetero atoms will be apparent to those skilled in the art and include, for example, sulfur, oxygen and nitrogen and form substituents such as, e.g., pyridyl, furanyl, thiophenyl, imidazolyl, etc.

In general, no more than about three radicals or hetero atoms, and preferably no more than one, will be present for each 5 carbon atoms in the hydrocarbon-based substituent. Preferably, there will be no more than three radicals per 10 carbon atoms.

Preferably, the hydrocarbon-based substituents in the compositions of this invention are free from acetylenic unsaturation. Ethylenic unsaturation, when present, preferably will be such that no more than one ethylenic lineage will be present for every 10 carbon-to-carbon bonds in the substituent. The hydrocarbon-based substituents are usually hydrocarbon in nature and more usually, substantially saturated hydrocarbon. As used in this specification and the appended claims, the word "lower" denotes substituents, etc. containing up to seven carbon atoms; for example, lower alkoxy, lower alkyl, lower alkenyl, lower aliphatic aldehyde.

(A) The Nitrogen Containing Dispersant

The nitrogen containing dispersant envisioned within this invention has a total base number (TBN) of from 20 to 160 on an oil-free basis. Any oil contained within the dispersant is subtracted out to determine the TBN. The TBN is defined as 56,100 mg KOH times equivalents of titratable nitrogen/grams of sample. Preferably the TBN of the dispersant is from 30 to 100 and most preferably from 30 to 80.

The nitrogen containing dispersants comprise the Mannich reaction products, succinimide dispersants, or olefin-carboxylic acid/carboxylate dispersants.

Mannich Dispersants

Mannich dispersants are the reaction product of a phenol, aldehyde and amine. There are several methods to prepare Mannich dispersants. The first method is to condense the phenol and aldehyde to make an intermediate product which is then condensed with the amine to form the Mannich dispersant. The second method is to condense the amine and aldehyde to make an intermediate product which is then condensed with the phenol to form the Mannich dispersant. The third method is to add all three reagents at once phenol, aldehyde and amine) to form the Mannich dispersant. Within this invention, it is preferred to form the Mannich dispersant by the first method.

The Mannich dispersants are prepared by reacting at least one intermediate (A1) of the formulae (A1)

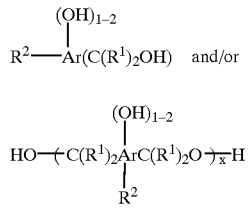

Formula I wherein each $R^1$ is independently hydrogen or lower hydrocarbon-based group; Ar is an aromatic moiety having at least one aliphatic, hydrocarbon-based substituent, $R^2$, of at least 6 carbon atoms; and x is an integer of 1 to about 10 with (A2) at least one amino compound which contains one or more amino groups having hydrogen bonded directly to an amino nitrogen.

The intermediate (A1) is itself prepared by reaction of two reagents.

The first reagent is a hydroxyaromatic compound. This term includes phenols (which are preferred); carbon-, oxygen-, sulfur- and nitrogen-bridged phenols and the like as well as phenols directly linked through covalent bonds (e.g., 4,4'-bis(hydroxy)biphenyl); hydroxy compounds derived from fused-ring hydrocarbons (e.g., naphthols and the like); and dihydroxy compounds such as catechol, resorcinol and hydroquinone. Mixtures of one or more hydroxyaromatic compounds can be used as the first reagent.

The hydroxyaromatic compounds used to make intermediate (A1) of this invention are substituted with at least one, and preferably not more than two, aliphatic or alicyclic substituents, $R^2$, having an average of at least about 30, preferably at least about 50 carbon atoms and up to about 7000 carbon atoms. Typically, such substituents can be derived from the polymerization of olefins such as ethylene, propylene, 1-butene, 2-butene, isobutene and the like. Both homoplymers (made from a single olefin monomer) and interpolymers (made from two or more of olefin monomers) can serve as sources of these substituents and are encompassed in the term "polymers" as used herein and in the appended claims. Substituents derived from polymers of ethylene, propylene, 1-butene and isobutene are preferred, especially those containing an average of at least about 30 and preferably at least about 50 aliphatic carbon atoms. Generally, these substituents contain an average of up to about 700, typically up to about 400 carbon atoms. In some instances, however, higher molecular weight substituents, e.g., those having molecular weights of about 50,000–100,000 are desirable since such substituents can import viscosity index improving properties to the composition. Such higher molecular weights can be calculated from the inherent or intrinsic viscosity using the Mark-Houwink equation and are called viscosity average molecular weights ($\overline{M}v$). Number average molecular weights ($\overline{M}n$) ranging from about 420 to 10,000 are conveniently measured by vapor pressure osmometry (VPO). (This method is used for the $\overline{M}n$ ranges with about 420 to 10,000 set forth herein.)

Introduction of the aliphatic or alicyclic substituent $R^2$ onto the phenol or other hydroxyaromatic compound is usually effected by mixing a hydrocarbon (or a halogenated derivative thereof, or the like) and the phenol at a temperature of about 50°–200° C. in the presence of a suitable catalyst, such as aluminum trichloride, boron trifluoride, zinc chloride or the like. See, for example, U.S. Pat. No. 3,368,972 which is incorporated by reference for its disclosures in this regard. The substituent can also be introduced by other alkylation processes known in the art.

The phenols used to make intermediate (A1) have the general formula

Formula II

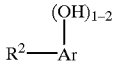

Especially preferred as the first reagent are mono-substituted phenols of the general formula Formula III

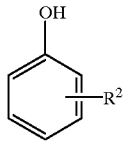

wherein $R^2$ is an aliphatic or alicyclic hydrocarbon-based substituent of $\overline{M}n$ (VPO) of about 420 to about 10,000. Typically, $R^2$ is an alkyl or alkenyl group of about 30 to about 400 carbons.

The second reagent used to make the intermediate (A1) is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, hexamethylene tetraamine, paraldehyde formalin and methal. Formaldehyde and its polymers (e.g., paraformaldehyde, trioxane) are preferred. Mixtures of aldehydes may be used as the second reagent.

In making intermediate (A1) of this invention, the hydroxyaromatic compound is reacted with the aldehyde in the presence of an alkaline reagent, at a temperature up to about 125° C. and preferably about 50°–125° C.

The alkaline reagent is typically a strong inorganic base such as an alkali metal base (e.g., sodium or potassium hydroxide). Other inorganic and organic bases can be used as the alkaline base such as $Na_2CO_3$, $NaHCO_3$, sodium acetate, pyridine, and hydrocarbon-based amines (such as methylamine, aniline, and alkylene polyamines, etc.) may also be used. Mixtures of one or more alkaline bases may be used.

The relative proportions of the various reagents employed in the first step are not critical; it is generally satisfactory to use about 1–4 equivalents of aldehyde and about 0.05–10.0 equivalents of alkaline reagent per equivalent of hydroxyaromatic compound. (As used herein, the term "equivalent" when applied to a hydroxyaromatic compound indicates a weight equal to the molecular weight thereof divided by the number of aromatic hydroxyl groups directly bonded to an aromatic ring per molecule. As applied to the aldehyde or precursors thereof, an "equivalent" is the weight required to produce one mole of monomeric aldehyde. An equivalent of alkaline reagent is that weight of reagent that when dissolved in one liter of solvent will give a normal solution. One equivalent of alkaline reagent will neutralize, i.e., bring to pH 7.0, a 1.0 normal solution of, e.g., hydrochloric or sulfuric acid.).

It is generally convenient to carry out the formation of intermediate (A1) in the presence of a substantially inert, organic liquid diluent, which may be a volatile or nonvolatile. A substantially inert, organic liquid diluent which may or may not dissolve all the reactants, is a material which does not substantially react with the reagents under the reaction conditions. Suitable diluents include hydrocarbons such as naphtha, textile spirits, mineral oil (which is preferred), synthetic oils (as described hereinbelow), benzene, toluene and xylene; alcohols such as isopropanol, n-butanol, isobutanol and 2-ethylhexanol; ethers such as ethylene or diethylene glycol mono- or diethyl ether; or the like, as well as mixtures thereof.

The reaction mixture containing the intermediate (A1) formed as just described is usually substantially neutralized. This is an optional step and it is not always employed. Neutralization can be effected with any suitable acidic material, typically a mineral acid or an organic acid or anhydride. Acidic gases such as carbon dioxide, hydrogen sulfide, and sulfur dioxide may also be used. Preferably neutralization is accomplished with carboxylic acids, especially lower hydrocarbon-based carboxylic acid such as formic, acetic or butyric acid. Mixtures of one or more acidic materials can be used to accomplish neutralization. The temperature of neutralization is up to about 150° C., preferably about 50–150° C. Substantial neutralization means the reaction mixture is brought to a pH ranging between about 4.5 and 8.0. Preferably, the reaction mixture is brought to a minimum pH of about 6 to a maximum of about 7.5.

Intermediate (A1) is usually a mixture of hydroxyalkyl derivatives of the hydroxyaromatic compound and ether condensation products thereof having the general formulae:

(A1)

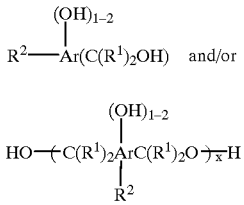

Formula IV wherein $R^1$, $R^2$, Ar and x are as defined hereinabove.

Typically, when the intermediate (A1) is made from mono-substituted phenols, it is a mixture of compounds of the general formulae:

(A1)

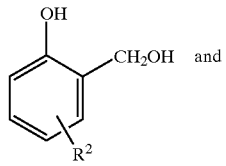

Formula V

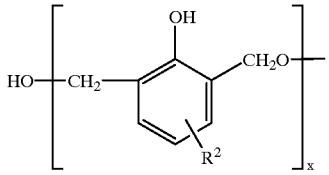

wherein $R^2$ is a substantially saturated aliphatic hydrocarbyl group of about 30 to about 700 carbon atoms.

A particular preferred class of intermediate (A1) are those made from para-substituted phenols and having the general formulae:

(A1)

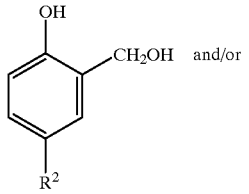

Formula VI

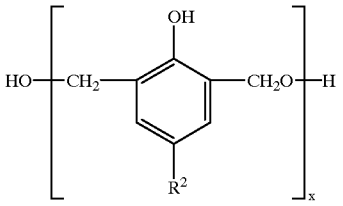

wherein $R^2$ is an alkyl or alkenyl group of about 30 to about 400 carbons and x is an integer of 1 to about 10. Exemplary of $R^2$ in these preferred intermediates are those made from polybutenes. These polybutenes are usually obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. They contain predominantly (greater than 80% of total repeat units) isobutylene repeating units of the configuration

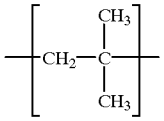

In other preferred intermediates, the $R^2$ is derived from a polypropylene polymer or an ethylene/propylene interpolymer containing an appropriate number of carbon atoms.

The intermediate (A1) is reacted with at least one amino compound (A2) which contains one or more amino groups having hydrogen directly bonded to amino nitrogen. Suitable amino compounds are those containing only primary, only secondary, or both primary and secondary amino groups, as well as polyamines in which all but one of the amino groups may be tertiary. Suitable amino compounds include ammonia, aliphatic amines, aromatic amines, heterocyclic amines and carbocyclic amines, as well as polyamines such as alkylene amines, arylene amines, cyclic polyamines and the hydroxy-substituted derivatives of such polyamines. Mixtures of two or more amino compounds can be used as the amino compound Specific amines of these types are methylamine, N-methylethylamine, N-methyl-octylamine, N-cyclohexyl-aniline, dibutylamine, cyclohexylamine, aniline, di(p-methyl-phenyl)-amine, ortho, meta and para-aminophenol, dodecylamine, octadecylamine, o-phenylenediamine, N,N'-di-n-butyl-p-phenylenediamine, morpho-line, N,N-di-n-butyl-p-phenylene-diamine, piperazine, tetrahydropyrazine, indole, hexa-hydro-1,3,5-triazine, 1-H-1,2,4-triazole, bis-(p-aminophenyl)-methane, menthane-diamine, cyclohexamine, pyrrolidine, 3-amino-5,6-diphenyl-1,2,4-triazine, quinone-diimine, 1,3-indanediimine, 2-octadecyl-imidazoline, 2-phenyl-4-methyl-imidazoline, oxazolidine, ethanolamine, diethanolamine, N-3-aminopropyl morpholine, phenothiazine, 2-heptyl-oxazolidine, 2-heptyl-3 -(2-aminopropyl) imidazoline, 4-methyl-imidazoline, 1,3-bis(2-aminoethyl) imidazoline, 2-heptadecyl-4-(2-hydroxyethyl-)imid-azoine and pyrimidine.

A preferred group of amino compounds consists of polyamines, especially alkylene polyamines conforming for the most part to the formula Formula VII

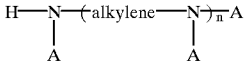

wherein n is an integer of 1 to about 10, A is a hydrocarbon-based substituent or hydrogen atom, preferably a lower alkyl group or a hydrogen atom, and the alkylene radical is preferably a lower alkylene radical of up to 7 carbon atoms. Mixtures of such polyamines are similarly useful. In certain instances, two A groups on the same amino nitrogen can be combined together, sometimes through a nitrogen atom and other times through carbon-to-carbon bonds to form a five or six membered ring including the amino nitrogen, two A groups and, optionally, oxygen or nitrogen.

The alkylene polyamines include principally polymethylene amines, ethylene amines, butylene amines, propylene amines, trimethylene amines, pentylene amines, hexylene amines, heptylene amines, octylene amines, and also the cyclic and the higher homologs of such amines such as piperazines and aminoalkyl-substituted piperazines. They are exemplified specifically by: ethylene diamine, triethylene tetramine, propylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, 1-(2-aminopropyl)piperazine, 1,4-bis(2-amino-ethyl) piperazine, and 2-methyl-1-(2-aminobutyl)piperazine. Higher homologs such as are obtained by condensing two or more of the above-illustrated alkylene amines likewise are useful. Examples of amines wherein two A groups are combined to form a ring include N-aminoethyl morpholine, N-3-aminopropyl-pyrrolidene, and aminoethylpiperazine, etc.

The ethylene polyamines are especially useful. They are described in some detail under the heading "Diamines and Higher Amines" in "Encyclopedia of Chemical Technology", Second Edition, Kirk and Othmer, Volume 7, pages 27–39, Interscience Publishers, New York (1965). Such compounds are prepared most conveniently by the reaction of an alkylene chloride with ammonia. The reaction results in the production of somewhat complex mixtures of alkylene polyamines, including cyclic condensation products such as piperazines. These mixtures find use in the process of this invention. On the other hand, quite satisfactory products may be obtained also by the use of pure alkylene polyamines. An especially useful alkylene polyamine for reasons of economy as well as effectiveness of the products derived therefrom is a mixture of ethylene amines prepared by the reaction of ethylene chloride and ammonia and containing about 3–7 amino groups per molecule.

Hydroxyalkyl-substituted alkylene polyamines, i.e., alkylene polyamines having one or more hydroxyalkyl substituents on the nitrogen atoms, likewise are contemplated for use herein. The hydroxyalkyl-substituted alkylene polyamines are preferably those in which the alkyl group is a lower alkyl group, i.e., an alkyl having less than 8 carbon atoms. Examples of such amines include N-(2-hydroxyethyl)ethylene diamine, N,N'-bis(2-hydroxyethyl) ethylene diamine, 1-(2-hydroxyethyl)piper-azine, mono-2-hydroxy-propyl-substituted diethylene triamine, 1 ,4-bis(2-hydroxy-propyl)piperazine, dihydroxy-propyl-substituted tetraethylene pentamine, N-(3 -hydroxypropyl) tetriamethylene diamine, etc.

Higher homologs such as are obtained by condensation of the above-illustrated alkylene polyamines or hydroxyalkyl-substituted alkylene polyamines through amino radicals or through hydroxy radicals are likewise useful. It will be appreciated that condensation through amino radicals results in a higher amine accompanied by removal of ammonia and that condensation through the hydroxy radicals results in products containing ether linkages accompanied by removal of water.

Another preferred class of amino compounds are aromatic amines containing about 6 to about 30 carbon atoms and at least one primary or secondary amino group. Preferably, these aromatic amines contain only 1–2 amino groups, 1–2 hydroxy groups, carbon and hydrogen. Examples include aryl amines such as the isomeric amino phenols, aniline, N-lower alkyl anilines, heterocyclic amines such as the isomeric amino pyridines, the isomeric naphthyl amines, phenothiazine, and the $C_{1-30}$ hydrocarbyl substituted analogs such as N-phenyl-alpha-naphthyl amine. Aromatic diamines such as the phenylene and naphthylene diamines can also be used.

Other suitable amino compounds include ureas, thioureas, (including lower alkyl and monohydroxy lower alkyl substituted ureas and thioureas), hydroxylamines, hydrazines, guanidines, amidines, amides, thioamides, cyanamides, amino acids and the like. Specific examples illustrating such compounds are: hydrazine, phenylhydrazine, N,N'-diphenylhydrazine, octadecylhydrazine, benzoylhydrazine, urea, thiourea, N-butylurea, stearylamide, oleylamide, guanidine, 1-phenylguanidine, benzamidine, octadecamidine, N,N'-dimethylstearamidine, cyanamide, dicyandiamide, guanylurea, aminoguanidine, iminodiacetic acid, iminodipropionitrile, etc.

The intermediate (A1) is reacted with the amino compound (A2), typically at a temperature between about 25° C. and about 225° C. and usually about 55–180° C. The ratio of reactants in this step is not critical, but about 1–6 equivalents of amino compound (A2) are generally employed per equivalent of intermediate (A1). (The equivalent weight of the amino compound is the molecular weight thereof divided by the number of hydrogens bonded to nitrogen atoms present per molecule and the equivalent weight of the intermediate (A1) is its molecular weight divided by the number of $—C(R^1)_2O—$ units present derived from the aldehyde. The number of equivalents of (A1) is conventionally calculated by dividing the moles of (A1) by the moles of aldehyde used to make it.) It is frequently convenient to react (A1) and (A2) in the presence of a substantially inert liquid solvent/diluent, such as that described hereinabove.

The course of the reaction between the intermediate (A1) and the amino compound (A2) may be determined by measuring the amount of water removed by distillation, azeotropic distillation or the like. When water evolution has ceased, the reaction may be considered complete and any solids present may be removed by conventional means; e.g., filtration, centrifugation, or the like, affording the desired product. It is ordinarily unnecessary to otherwise isolate the product from the reaction mixture or purify it, though, in some instances it may be desirable to concentrate (e.g., by distillation) or dilute the solution/dispersion of the product for ease of handling, etc.

The method of this invention is illustrated by the following examples. All parts are by weight and all molecular weights are determined by V.P.O. unless otherwise indicated.

EXAMPLE A-1

A mixture of 1560 parts (1.5 equivalents) of a polyisobutylphenol having a molecular weight of about 885, 1179 parts of mineral oil and 99 parts of n-butyl alcohol is heated to 80° C. under nitrogen, with stirring, and 12 parts (0.15 equivalent) of 50% aqueous sodium hydroxide solution is added. The mixture is stirred for 10 minutes and 99 parts (3 equivalents) of paraformaldehyde is added. The mixture is stirred at 80°–88° C. for 1.75 hours and then neutralized with 9 parts (0.15 equivalent) of acetic acid.

To the solution of intermediate thus obtained is added at 88° C., with stirring, 172 parts of a commercial polyethylene polyamine mixture containing about 3–7 nitrogen atoms per molecule and about 34.5% by weight nitrogen. The mixture is heated over about 2 hours to 150° C. and stirred at 150°–160° C. for three hours, with volatile material being removed by distillation. The remainder of the volatiles are then stripped at 160° C./30 torr, and the residue filtered at 150° C., using a commercial filter aid material, to yield the desired product as a filtrate in the form of 60% solution in mineral oil containing 1.95% nitrogen.

EXAMPLE A-2

A solution of 4576 parts (4.4 equivalents) of the polyisobutylphenol of Example A-1 in 3226 parts of mineral oil is heated to 55° C. under nitrogen, with stirring, and 18 parts (0.22 equivalent) of 50% aqueous sodium hydroxide solution is added. The mixture is stirred for 10 minutes and then 320 parts (9.68 equivalents) of paraformaldehyde is added. The mixture is heated at 70–80° C. for 13 hours and then cooled to 60° C. whereupon 20 parts (0.33 equivalent) of acetic acid is added. The mixture is then heated at 110° C. for 6 hours while being blown with nitrogen to remove volatile materials. Nitrogen blowing is continued at 130° C. for an additional 6 hours, after which the solution is filtered at 120° C., using a filter aid material.

To the above solution of intermediate (i.e., alkylphenol/formaldehyde condensate), at 65° C. is added 184 parts of the polyethylene polyamine of Example A-1. The mixture is heated at 110°–135° C. over 4 hours and then blown with nitrogen at 150°–160° C. for 5 hours to remove volatiles. Mineral oil, 104 parts, is added and the mixture filtered at 150° C., using filter aid, to yield the desired product as a 60% solution in mineral oil containing 1.80% nitrogen.

EXAMPLE A-3

To 366 parts (0.2 equivalent) of the intermediate solution described in Example A-2 is added at 60° C., with stirring, 43.4 parts (0.3 equivalent) of N-(3-aminopropyl) morpholine. The mixture is heated at 110°–130° C., with nitrogen blowing, for 5 hours. It is then stripped of volatiles at 170° C./16 torr, and filtered using a filter aid material. The filtrate is the desired product (as a 62.6% solution in mineral oil) containing 1.41% nitrogen.

EXAMPLE A-4

Following the procedure of Example A-3, a reaction product is prepared from 366 parts (0.2 equivalent) of the intermediate solution of Example 2 and 31.5 parts (0.3 equivalent) of diethanolamine. It is obtained as a 62.9% solution in mineral oil, containing 0.70% nitrogen.

EXAMPLE A-5

A mixture of 2600 parts (2.5 equivalents) of the polyisobutylphenol of Example A-2, 750 parts of textile spirits and 20 parts (0.25 equivalent) of 50% aqueous sodium hydroxide is heated to 55° C. under nitrogen, with stirring, and 206 parts (6.25 equivalents) of paraformaldehyde is added. Heating at 50°–55° C., with stirring, is continued for 21 hours after which the solution is blown with nitrogen and heated to 85° C. as volatile materials are removed. Acetic acid, 22 parts (0.37 equivalent), is added over one-half hour at 85°–90° C., followed by 693 parts of mineral oil.

To 315 parts (0.231 equivalent) of the solution of alkylphenol/formaldehyde intermediate prepared as described above is added under nitrogen, at 65° C., 26.5 parts of the polyethylene polyamine mixture of Example A-1. The mixture is heated at 65°–90° C. for about 1 hour, and then heated to 120°–130° C. with nitrogen blowing, and finally to 145°–155° C. with continued nitrogen blowing for 3.5 hours. Mineral oil, 57 parts, is added and the solution filtered at 120° C., using a filter aid material. The filtrate is the desired product (69.3% solution in mineral oil) containing 2.11% nitrogen.

EXAMPLE A-6

A solution of 340 parts (0.25 equivalent) of the alkylphenol/formaldehyde intermediate solution of Example A-5 in 128 parts of mineral oil is heated to 45° C. and 30 parts (0.25 equivalent) of tris-(methylol)methyl amine is added, with stirring. The mixture is heated to 90° C. over 0.5 hours, and then blown with nitrogen at 90°–130° C. for 3 hours, with stirring. Finally, it is heated to 150°–160° C. for 5 hours, with nitrogen blowing, cooled to 125° C. and filtered, using a filter aid material. The filtrate is the desired product (as a 60% solution in mineral oil) containing 0.19% nitrogen.

EXAMPLE A-7

To a mixture of 1560 parts (1.5 equivalents) of the polyisobutylphenol of Example A-2 and 12 parts (0.15 equivalent) of 50% aqueous sodium hydroxide solution is added at 68° C., with stirring, 99 parts (3 equivalents) of paraformaldehyde. The addition period is 15 minutes. The mixture is then heated to 88° C. and 100 parts of a mixture of isobutyl and primary amyl alcohols is added. Heating at 85°–88° C. is continued for 2 hours and then 16 parts of glacial acetic acid is added and the mixture stirred for 15 minutes and vacuum stripped at 150° C. To the residue is added 535 parts of mineral oil, and the oil solution is filtered to yield the desired intermediate.

To 220 parts (0.15 equivalent) of the intermediate solution prepared as described above is added 7.5 parts (0.15 equivalent) of hydrazine hydrate. The mixture is heated to 80°–105° C. and stirred at that temperature for 4 hours. Acetic acid, 0.9 part, is then added and stirring is continued at 95°–125° C. for an additional 6 hours. A further 7.5-part-portion of hydrazine hydrate is added and heating and stirring are continued for 8 hours, after which the product is stripped of volatiles under vacuum at 124° C. and 115 parts of mineral oil is added. Upon filtration, the desired product (as a 50% solution in mineral oil) is obtained; it contains 1.19% nitrogen.

EXAMPLE A-8

A mixture of 6240 parts (6 equivalents) of the polyisobutylphenol of Example A-2 and 2814 parts of mineral oil is heated to 60° C. and 40 parts (0.5 equivalent) of 50% aqueous sodium hydroxide solution added, with stirring. The mixture is stirred for 0.5 hour at 60° C., and 435 parts (13.2 equivalents) of 91% aqueous formaldehyde solution is added at 75°–77° C. over 1 hour. Stirring at this temperature is continued for 10 hours, after which the mixture is neutralized with 30 parts of acetic acid and stripped of volatile materials. The residue is filtered using a filter aid material.

A mixture of 629 parts (0.4 equivalent) of the resulting intermediate solution and 34 parts (0.4 equivalent) of dicyandiamide is heated to 210° C. under nitrogen, with stirring, and maintained at 210°–215° C. for 4 hours. It is then filtered through a filter aid material and the filtrate is the desired product (as a 71% solution in mineral oil) containing 1.04% nitro-en.

EXAMPLE A-9

A mixture of 1792 parts (1.6 equivalents) of the polyisobutylphenol of Example A-2 and 1350 parts of xylene is heated to 60° C. and 12.8 parts (0.16 equivalent) of 50% aqueous sodium hydroxide solution added, with stirring. The mixture is stirred at 60°–65° C. for 10 minutes, and then 108 parts (3.28 equivalents) of paraformaldehyde is added. Heating is continued at 65°–75° C. for 5 hours, after which 14.3 parts (0.24 equivalent) of acetic acid is added. The acidified mixture is heated at 75°–125° C. for ½ hour and then stripped under vacuum. The resulting solution of intermediate is filtered through a filter aid material.

To 2734 parts (1.4 equivalents) of the above-described intermediate solution, maintained at 65° C., is added 160.7 parts of the polyethylene polyamine of Example A-1. The mixture is heated for 1½ hours at 65°–110° C. and for 1½ hours at 110°–140° C., after which heating at 140° C. is continued with nitrogen blowing for 11 hours, while a xylene-water azeotrope is collected by distillation. The residual liquid is filtered at 100° C., using a filter aid material, and the filtrate is the desired product as a 60% solution in xylene containing 1.79% nitrogen.

Succinimide Dispersants

The starting material for succinimide dispersants is a hydrocarbyl substituted succinic acylating agent. Two different succinimide dispersants are envisioned in this invention. The succinimide dispersants are the reaction product of a hydrocarbyl substituted succinic acylating agent and an amine. The succinimide dispersants formed depend upon the type of the hydrocarbyl substituted succinic acylating employed. Two types of hydrocarbyl substituted succinic acylating agents are envisioned as Type I and Type II. The Type I succinic acylating agent is of the formula

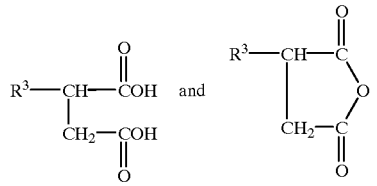

In the above formula, $R^3$ is a hydrocarbyl based substituent having from 40 to 500 carbon atoms and preferably from 50 to 300 carbon atoms. The Type I hydrocarbyl-substituted succinic acylating agents are prepared by reacting one mole of an olefin polymer or chlorinated analog thereof with one mole of an unsaturated carboxylic acid or derivative thereof such as fumaric acid, maleic acid or maleic anhydride. Typically, the Type I succinic acylating agents are derived from maleic acid, its isomers, anhydride and chloro and bromo derivatives.

The Type II hydrocarbyl substituted succinic acylating agent, hereinafter Type I succinic acylating agent, is characterized as a polysuccinated hydrocarbyl substituted succinic acylating agent such that more than one mole of an unsaturated carboxylic acid or derivative is reacted with one mole of an olefin polymer or chlorinated analog thereof.

The olefin monomers from which the olefin polymers are derived that ultimately become $R^3$ are essentially the same as the substituent $R^2$ in the 2 i preparation of the Mannich dispersants. The salient difference is that R is from 30 to 7000 carbon atoms and $R^3$ is from 40 to 500 carbon atoms and preferably from 50 to about 300 carbon atoms. That being the case, it is not necessary to repeat the disclosure.

As noted above, the hydrocarbon-based substituent $R^3$ present in the Type I acylating agent is derived from olefin polymers or chlorinated analogs thereof. The olefin monomers from which the olefin polymers are derived are polymerizable olefins and monomers characterized by having one or more ethylenic unsaturated group. They can be monoolefinic monomers such as ethylene, propylene, butene-1, isobutene and octene-1, or polyolefinic monomers (usually di-olefinic monomers such as butadiene-1,3 and isoprene). Usually these monomers are terminal olefins, that is, olefins characterized by the presence of the group $$>C{=}CH_2$$

However, certain internal olefins can also serve as monomers (these are sometimes referred to as medial olefins). When such olefin monomers axe used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl groups such as para(tertiary butyl)phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally, the olefin polymers are homo- or interpolymers of terminal hydrocarbyl olefins of about 2 to about 16 carbon atoms. A more typical class of olefin polymers is selected from that group consisting of homo- and interpolymers of terminal olefins of two to six carbon atoms, especially those of two to four carbon atoms.

Specific examples of terminal and medial olefin monomers which can be used to prepare the olefin polymers from which the hydrocarbon based substituents in the acylating agents used in this invention are ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2 butadiene-1,3 pentadiene-1,2 pentadiene-1,3, isoprene, hexadiene-1,5, 2-chlorobutadiene-1,3,2-methylheptene-1,3-cyclohexylbutene-1, 3,3-dimethylpenitene-1, styrenedivinylbenzene, vinylacetate, allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutene)s. These polyisobutenyl polymers may be obtained by polymerization of a $C_4$ refinery stream having a butene content of about 35 to about 75 percent by weight and an isobutene content of about 30 to about 60 percent by weight in the presence of a Lewis acid catalyst such as aluminum chloride or boron trifluoride. These poly(isobutene)s contain predominantly (that is, greater than 80% of the total repeat units) isobutene repeat units of the configuration

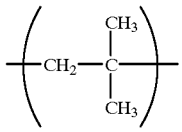

The hydrocarbyl-substituted succinic acylating agent is represented by $R^{19}$ and is a hydrocarbyl, alkyl or alkenyl group of about 40, often about 50, to about 500, sometimes about 300, carbon atoms. U.S. Pat. No. 4,234,435 is expressly incorporated herein by reference for its disclosure of procedures for the preparation of polysuccinated hydrocarbyl-substituted succinic acylating agents and dispersants prepared therefrom.

The Type II succinic acid acylating agents can be made by the reaction of maleic anhydride, maleic acid, or fumaric acid with the afore-described olefin polymer, as is shown in the patents referred to above. Generally, the reaction involves merely heating the two reactants at a temperature of about 150° C. to about 200° C. Mixtures of these polymeric olefins, as well as mixtures of these unsaturated mono- and polycarboxylic acids can also be used.

In another embodiment, the Type I acylating agent consists of substituent groups and succinic groups wherein the substituent groups are derived from polyalkenes characterized by an Mn value of at least about 1200 and an Mw/Mn ratio of at least about 1.5, and wherein said acylating agents are characterized by the presence within their structure of an average of at least about 1.3 succinic groups for each equivalent weight of substituent groups.

The Type II substituted succinic acylating agent can be characterized by the presence within its structure of two groups or moieties. The first group or moiety is referred to hereinafter, for convenience, as the "substituent group(s)" $R^4$ and is derived from a polyalkene. The polyalkene from which the substituted groups are derived is characterized by an Mn (number average molecular weight) value of at least 1200 and more generally from about 1500 to about 5000, and an Mw/Mn value of at least about 1.5 and more generally from about 1.5 to about 6. The abbreviation Mw represents the weight average molecular weight. The number average molecular weight and the weight average molecular weight of the polybutenes can be measured by well-known techniques of vapor phase osmometry (VPO), membrane osomometry and gel permeation chromatography (GPC). These techniques are well-known to those skilled in the art and need not be described herein.

The second group or moiety is referred to herein as the "succinic group(s)". The succinic groups are those groups characterized by the structure (VIII)

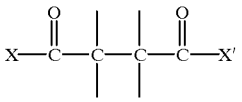

wherein X and X' are the same or different provided at least one of X and X' is such that the Type II substituted succinic acylating agent can function as carboxylic acylating agents. That is, at least one of X and X' must be such that the substituted acylating agent can form amides or amine salts with, and otherwise function as a conventional carboxylic acid acylating agents. Transesterification and transamidation reactions are considered, for purposed of this invention, as conventional acylating reactions.

Thus, X and/or X' is usually —OH, —O-hydrocarbyl, —O—$M^+$ where $M^+$ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C—(O)X and —C(O)X' can enter into acylation reactions.

One of the unsatisfied valences in the grouping

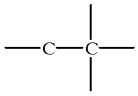

of Formula VIII forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The Type II succinic acylating agents are characterized by the presence within their structure of 1.3 succinic groups (that is, groups corresponding to Formula VIII) for each equivalent weight of substituent groups $R^{19}$. For purposes of this invention, the number of equivalent weight of substituent groups $R^{19}$ is deemed to be the number corresponding to the quotient obtained by dividing the Mn value of the polyalkene from which the substituent is derived into the total weight of the substituent groups present in the substituted succinic acylating agents. Thus, if the Type II succinic acylating agent is characterized by a total weight of substituent group of 40,000 and the Mn value for the polyalkene from which the substituent groups are derived is 2000, then that Type II substituted succinic acylating agent is characterized by a total of 20 (40,000/2000=20) equivalent weights of substituent groups. Therefore, that particular Type II succinic acylating agent must also be characterized by the presence within its structure of at least 26 succinic groups to meet one of the requirements of the novel succinic acylating agents of this invention.

Another requirement for the Type II succinic acylating agents is that the substitutent group $R^{19}$ must have been derived from a polyalkene characterized by an Mw/Mn value of at least about 1.5.

Polyalkenes having the Mn and Mw values discussed above are known in the art and can be prepared according to conventional procedures. Several such polyalkenes, especially polybutenes, are commercially available.

In one preferred embodiment, the succinic groups will normally correspond to the formula (IX)

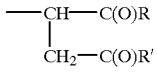

wherein R and R are each independently selected from the group consisting of —H, —Cl, —O-lower alkyl, and when taken together, R and R' are —O—. In the latter case, the succinic group is a succinic anhydride group. All the succinic groups in a particular Type II succinic acylating agent need not be the same, but they can be the same. Preferably, the succinic groups will correspond to (X)

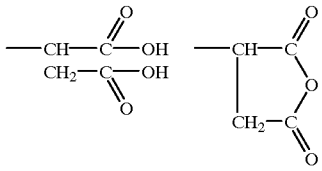

(A) (B)

and mixtures of (X(A)) and (X(B)). Providing Type II succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is 1.3. The maximum number generally will not exceed 6. Preferably the minimum will be 1.4; usually 1.4 to about 6 succinic groups for each equivalent weight of substituent group. A range based on this minimum is at least 1.5 to about 3.5, and more generally about 1.5 to about 2.5 succinic groups per equivalent weight of substituent groups.

From the foregoing, it is clear that the Type II succinic acylating agents can be represented by the symbol $R^{19}(R^{20})_y$ wherein $R^{19}$ represents one equivalent weight of substituent group, $R^{20}$ represents one succinic group corresponding to Formula (VIH), Formula (IX), or Formula (X), as discussed above, and y is a number equal to or greater than 1.3. The more preferred embodiments of the invention could be similarly represented by, for example, letting $R^{19}$ and $R^{20}$ represent more preferred substituent groups and succinic groups, respectively, as discussed elsewhere herein and by letting the value of y vary as discussed above.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of Mn for example, a minimum of about 800 and a maximum of about 5000 are preferred with an Mn value in the range of from about 1300 or 1500 to about 5000 also being preferred. A more preferred Mm value is one in the range of from about 1500 to about 2800. A most preferred range of Mn values is from about 1500 to about 2400. With polybutenes, an especially preferred minimum value for Mn is about 1700 and an especially preferred range of Mn values is from about 1700 to about 2400.

As to the values of the ratio Mw/Mn, there are also several preferred values. A minimum Mw/Mn value of about 1.8 is preferred with a range of values of about 1.8 up to about 5.0 also being preferred. A still more preferred minimum value of Mw/Mn is about 2.0 to about 4.5 also being a preferred range. An especially preferred minimum value of Mw/Mn is about 2.5 with a range of values of about 2.5 to about 4.0 also being especially preferred.

Before proceeding to a further discussion of the polyalkenes from which the substituent groups are derived, it should be pointed out that these preferred characteristics of the Type II succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of Mn or Mw/Mn. They are intended to be dependent in the sense that, for example, when a preference for a minimum of 1.4 to 1.5 succinic groups is combined with more preferred values of Mn and/or Mw/Mn, the combination of preferences does, in fact, describe still further more preferred embodiments of this component. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

The polyalkenes from which the substituent groups are derived are homopolymers and interpolymers of polymerizable olefin monomers as disclosed within R above.

In preparing the Type II succinic acylating agent, one or more of the above-described polyalkenes is reacted with one or more acidic reactants selected from the group consisting of maleic or fumaric reactants of the general formula $$X(O)C—CH=CH—C(O)X' \quad (XI)$$

wherein X and X' are as defined hereinbefore. Preferably the maleic and fumaric reactants will be one or more compounds corresponding to the formula $$RC(O)—CH=CHC(O)R' \quad (XII)$$

wherein R and R' are as previously defined herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the Type II substituted succinic acylating agent. The especially preferred reactants are maleic acid, maleic anhydride, and mixture of these. Due to availability and ease of reaction, maleic anhydride will usually be employed.

The one or more polyalkenes and one or more maleic or fumaric reactants can be reacted according to any of several known procedures in order to produce the Type I or Type II acylating agents of the present invention. In preparing the succinimide dispersant, the hydrocarbyl substituted succinic acylating agent is reacted with (a) ammonia, or (b) an amine.

The substituted succinic anhydride, as Type I or Type II, ordinarily is reacted directly with an ethylene amine or a condensed polyamine although in some circumstances it may be desirable first to convert the anhydride to the acid before reaction with the amine. In other circumstances, it may be desirable to prepare the substituted succinic acid by some other means and to use an acid prepared by such other means in the process. In any event, either the acid or the anhydride may be used in this invention.

The term "ethylene amine" is used in a generic sense to denote a class of polyamines conforming for the most part of the structure $$H_2N(CH_2\underset{\underset{R^5}{|}}{C}HNH)_xH$$

in which x is an integer and $R^5$ is a low molecular weight alkyl radical or hydrogen. Thus it includes, for example, ethylene diamine, diethylene triamine, triethylene tetramine, tetraethylene pentamine, pentaethylene hexamine, etc. These compounds are discussed in some detail under the heading "Ethylene Amines" in "Encyclopedia of Chemical Technology," Kirk and Othmer, vol. 5, pages 898–905, Interscience Publishers, New York (1950) and also within the Mannich dispersant as (A2). Such compounds are prepared most conveniently by the reaction of ethylene dichloride with ammonia. This procedure results in the production of somewhat complex mixtures of ethylene amines, including cyclic condensation products such as piperazines and these mixtures find use in the process of this invention. On the other hand, quite satisfactory products may be obtained also by the use of pure ethylene amines. An especially useful ethylene amine, for reasons of economy as well as effectiveness as a dispersant, is a mixture of ethylene amines prepared by the reaction ethylene chloride and ammonia, having a composition which corresponds to that of tetraethylene pentamine. This is available in the trade under the trade name "Polyamine H."

It has been noted that at least one half of a chemical equivalent amount of the ethylene amine per equivalent of substituted succinic anhydride must be used in the process to produce a satisfactory product with respect to dispersant properties and generally it is preferred to use these reactants in equivalent amounts. Amounts up to 2.0 chemical equivalents (per equivalent of substituted succinic anhydride) have been used with success, although there appears to be no advantage attendant upon the use of more than this amount. The chemical "equivalency" of the ethylene amine reactant is upon the nitrogen content, i.e., one having four nitrogens per molecule has four equivalents per mole.

In the reactions that follow, the amine is $RNH_2$ and it is understood that the $RNH_2$ is an ethylene amine.

The reaction of the process involves a splitting out of water and the reaction conditions are such that this water is removed as it is formed. Presumably, the first principal reaction that occurs, following salt formation, is the formation of a half amide

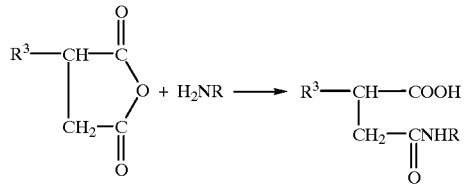

followed then by reaction of the acid and amide functionalities to form the succinimide.

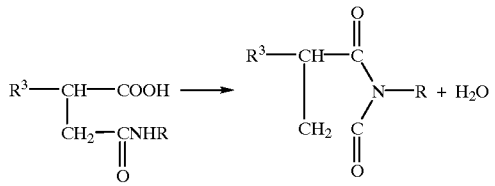

The first reaction appears to take place spontaneously (when a substituted succinic anhydride is used) upon mixing, but the second requires heating. Temperatures within the range of about 80° C. to about 200° C. are satisfactory, and within this range it is preferred to use a reaction temperature of from about 100° C. to about 160° C. A useful method of carrying out this step is to add some toluene to the reaction mixture and to remove the water by azeotropic distillation. As indicated before there is also some salt formation.

Specific examples of the process by which the succinic dispersants may be prepared utilizing the Type I succinic acylating agent are as follows.

EXAMPLE A-10

A polyisobutenyl succinic anhydride was prepared by the reaction of a chlorinated polyisobutylene with maleic anhydride at 200° C. The polyisobutenyl radical had an average molecular weight of 850 and the resulting alkenyl succinic anhydride was found to have an acid number of 113 (corresponding to an equivalent weight of 500). To a mixture of 500 grams (1 equivalent) of this polyisobutenyl. succinic anhydride and 160 grams of toluene there was added at room temperature 35 grams (1 equivalent) of diethylene triamine. The addition was made portion-wise throughout a period of 15 minutes, and an initial exothermic reaction caused the temperature to rise to 50° C. The mixture then was heated and a water-toluene azeotrope distilled from the mixture. When no more water would distill, the mixture was heated to 150° C. at reduced pressure to remove the toluene. The residue was diluted with 350 grams of mineral oil and this solution was found to have a nitrogen content of 1.6%.

EXAMPLE A-11

The procedures of Example A-10 was repeated using 31 grams (1 equivalent) of ethylene diamine as the amine reactant. The nitrogen content of the resulting product was 1.4%.

EXAMPLE A-12

The procedure of Example A-10 was repeated using 55.5 crams (1.5 equivalents) of an ethylene amine mixture having a composition corresponding to that of triethylene tetramine. The resulting product had a nitrogen content of 1.9%.

EXAMPLE A-13

The procedure of Example A-10 was repeated using 55.0 grams (1.5 equivalents) of triethylene tetramine as the amine reactant. The resulting product had a nitrogen content of 2.2%.

EXAMPLE A-14

To a mixture of 140 grams of toluene and 400 grams (0.78 equivalent) of a polyisobutenyl succinic anhydride Caving an acid number of 109 and prepared from maleic anhydride and the chlorinated polyisobutylene of Example A-10) there was added at room temperature 63.6 grams (1.55 equivalents) of an ethylene amine mixture having an average composition corresponding to that of tetraethylene pentamine and available from Union Carbide under the trade name "Polyamine H." The mixture was heated to distill the water-toluene azeotrope and then to 150° C. at reduced pressure to remove the remaining toluene. The residual polyamide had a nitrogen content of 4.7%.

EXAMPLE A-15

The procedure of Example A-10 was repeated using 46 grams (1.5 equivalents) of ethylene diamine as the amine reactant. The product which resulted had a nitrogen content of 1.5%.

EXAMPLE A-16

A polyisobutenyl succinic anhydride having an acid number of 100 and an equivalent weight of 560 was prepared by the reaction of a chlorinated polyisobutylene (having an average molecular weight of 1,050 and a chlorine content of 4.3%) and maleic anhydride. To a mixture of 300 parts by weight of the polyisobutenyl succinic anhydride and 160 parts of weight of mineral oil there was added at 65–95° C. an equivalent amount (25 parts of weight) of Polyamine H (identified in Example A-14). This mixture then was heated to 150° C. to distill all of the water formed in the reaction. Nitrogen was bubbled through the mixture at this temperature to insure removal of the last traces of water. The residue was diluted by 79 parts by weight of mineral oil and this oil solution found to have a nitrogen content of 1.6%.

EXAMPLE A-17

A mixture of 2,112 grams (3.9 equivalent) of the polyisobutenyl succinic anhydride of Example A-16, 136 grams (3.9 equivalents) of diethylene triamine, and 1,060 grams of mineral oil was heated at 140–150° C. for one hour. Nitrogen was bubbled through the mixture at this temperature for four more hours to aid in the removal of water. The residue was diluted with 420 grams of mineral oil and this oil solution was found to have a nitrogen content of 1.3%.

EXAMPLE A-18

To a solution of 1,000 grams (1.87 equivalents) of the polyisobutenyl succinic anhydride of Example A-16, in 500 grams of mineral oil there was added at 85–95° C. 70 grams (1.87 equivalents) of tetraethylene pentamine. The mixture then was heated at 150–165° C. for four hours, blowing with nitrogen to aid in the removal of water. The residue was diluted with 200 grams of mineral oil and the oil solution found to have a nitrogen content of 1.4%.

Specific examples for the preparation of succinic dispersants utilizing the Type II succinic acylating agent are as follows.

EXAMPLE A-19

A mixture of 51100 parts (0.28 mole) of polyisobutene ($\overline{M}n$=1845; $\overline{M}w$=5325) and 59 parts (0.59 mole) of maleic anhydride is heated to 1 10° C. This mixture is heated to 190° C. in seven hours during which 43 p arts (0.6 mole) of gaseous chlorine is added beneath the surface. At 190°–192° C. an additional 11 parts (0.16 mole) of chlorine is added over 3.5 hours. The reaction mixture is stripped by heating at 190°–193° C. with nitrogen blowing for 10 hours. The residue is the desired polyisobuatene-substituted Type II succinic acylating agent having a saponification equivalent number of 87 as determined by ASTM procedure D-94.

A mixture is prepared by the addition of 10.2 parts (0.25 equivalent) of a commercial mixture of ethylene polyamines having about 3 to about 10 nitrogen atoms per molecule to 113 parts of mineral oil and 161 parts (0.25 equivalent) of the substituted succinic acylating agent prepared above at 138° C. The reaction mixture is heated to 150° C. in 2 hours and stripped by blowing with nitrogen. The reaction mixture is filtered to yield the filtrate as an oil solution of the desired product.

EXAMPLE A-20

A mixture of 1000 parts (0.495 mole) of polyisobutene (MD n 2020; Mw=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C. an additional 59 part (0.83 mole) of chlorine is added over 4 hours. The reaction mixture is stripped by heating, at 186°–190° C. with nitrogen blowing for 26 hours. The residue is the desired polyisobutene-substituted Type II succinic acylating agent having a saponification equivalent number of 87 as determined by ASTM procedure D-94.

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the above-prepared succinic acylating agent at 140°–145° C. The reaction mixture is heated to 155° C. in 3 hours and stripped by blowing with nitrogen. The reaction mixture is filtered to yield the filtrate as an oil solution of the desired product.

EXAMPLE A-21

Added to a reactor is 1000 parts (0.5 mole) of a polyisobutene ($\overline{M}n$=2000, $\overline{M}w$=7000). The contents are heated to 135° C. and 106 parts (1.08 moles) of maleic anhydride is added. The temperature is increased to 165° C. and gaseous chlorine, 90 parts (1.27 moles) is added over a six hour period. During the chlorine addition, the temperature increases to 190° C.

To 1000 parts of the above product is added 1050 parts diluent oil and the contents are heated to 110° C. at which time 69.4 parts (1.83 equivalents) of polyamines is added. The temperature increases to 132° C. during the polyamine addition. The temperature is increased to 150° C. while blowing with nitrogen. Oil, 145 parts, is added and the contents are filtered to give a product containing 53% oil, 1.1% nitrogen and 21 total base number.

The term "condensed polyamine" or its cognate "polyamine condensates" are polyamines prepared by the reaction of a polyhydric alcohol having three hydroxy groups or an amino alcohol having two or more hydroxy groups that is reacted with an alkylene polyamine having at least two primary nitrogen atoms and wherein the alkylene group contains 2 to about 10 carbon atoms; and wherein the reaction is conducted in the presence of an acid catalyst at an elevated temperature.

Methods for preparing this condensed polyamine are well-known in the art and need not be illustrated in further detail here. For example, see U.S. Pat. No. 5,368,615, which is hereby incorporated by reference for its disclosure to the preparation of this condensed polyamine.

The succinic acid acylating agent can also react with hydroxyamines (amino alcohols).

Amino alcohols contemplated as suitable for use have one or more amine groups and one or more hydroxy groups. Examples of suitable amino alcohols are the N-(hydroxy-lower alkyl)amines and polyamines such as 2-hydroxyethylamine, 3-hydroxybutylamine, di-(2-hydroxyethyl)amine, tri(2-hydroxyethyl)amine, di-(2-hydroxypropyl)amine, N,N,N'-tri(2-hydroxyethyl) ethylenediamine, N,N,N'N'-tetra(2-hydroxyethyl) ethylenediamine, N-(2-hydroxyethyl)-piperazine, N,N'-di-(3-hydroxy-propyl)piperazine, N-(2-hydroxyethyl) morpholine, N-(2-hydroxyethyl)-2-morphol-inone, N-(2-hydroxyethyl)-3-methyl-2-morpholinone, N-(2-hydroxypropyl-6-methyl-2-morpholinone, N-(2-hydroxyethyl-5-carbethoxy-2-piperidone, N-(2-hydroxypropyl)-5-carbethoxy-2-piperidone, N-(2-hydroxyethyl)-5-(N-butylcarbamyl-2-piperidone, N-(2-hydroxyethyl-piperidine, N-(4-hydroxybutyl)-piperidine, N,N-di-(2-hydroxyethyl)-glycine, and ethers thereof with aliphatic alcohols, especially lower alkanols, N,N-di(3-hydroxypropyl)glycine, and the like. Also contemplated are other mono-and poly-N-hydroxyalkyl-substituted alkylene polyamines wherein the alklylene polyamine are as described above; especially those that contain two to three carbon atoms in the alkylene radicals and the alkylene polyamine contains up to seven amino groups such as the reaction product of about two moles of propylene oxide and one mole of diethylenetriamine.

Further amino alcohols are the hydroxy-substituted primary amines described in U.S. Pat. No. 3,576,743 by the general formula $$R_a—NH_2$$

where $R_a$ is a monovalent organic radical containing at least one alcoholic hydroxyl group, according to this patent, the total number of carbon atoms in $R_a$ will not exceed about 20. Hydroxy-substituted aliphatic primary amines containing a total of up to about 10 carbon atoms are particularly useful. Especially preferred are the polyhydroxy-substituted alkanol primary amines wherein there is only one amino group present (i.e., a primary amino group) having one alkyl substituent containing up to 10 carbon atoms and up to 6 hydroxyl groups. These alkanol primary amines correspond to $$R_a—NH_2$$

where $R_a$ is a mono- or polyhydroxy-substituted alkyl group. It is desirable that at least one of the hydroxyl groups be a primary alcoholic hydroxyl group. Trismethylolamino-methane is the single most preferred hydroxy-substituted primary amine. Specific examples of the hydroxy-substituted primary amines include 2-amino-1-butanol, 2-amino-2-methyl-1-propanol, p-(beta-hydroxyethyl)-analine, 2-amino-1-propanol, 3-amino-1-propanol, 2-amino-2-methyl-1,3-propanediol, 2-amino-2-ethyl-1,3-propanediol, N-(beta-hydroxypropyl)-N'-betaaminoethyl)-piperazine, tris(-hydoxy-methyl)amino methane (also known as trismethylolamino methane), 2-amino-1-butynol, ethanolamine, beta-(beta-hydroxy ethoxy)-ethyl amine, glucamine, gluco-samine, 4-amino-3-hydroxy-3-methyl-1-butene (which can be prepared according to procedures known in the art by reacting isopreneoxide with ammonia), N-(3-aminopropyl)-4-(2-hydroxyethyl)-piperadine, 2-amino-6-methyl-6-hepanol, 5-amino-1-pentanol, N-(beta-hydroxyethyl)-1,3-diamino propane, 1,3-diamino-2-hydroxy-propane, N-(beta-hydroxy ethoxyethyl) ethylenediamine, and the like. For further description of the hydroxy-substituted primary amines contemplated as being useful as (a), and/or (b), U.S. Pat. No. 3,576,743 is expressly incorporated herein by reference for its disclosure of such amines.

In examples A-10 to A-18 the polyisobutyl succinic anhydride is prepared by reacting polyisobutene having a molecular weight of 1000 with chlorine to generate a chlorinated polyisobutene. The chlorinated polyisobutene is reacted with maleic anhydride to form the hydrocarbon-substituted succinic anhydride and by-product hydrogen chloride. The concern with this procedure is that there is residual chloride in the hydrocarbon-substituted succinic anhydride and when further reacted with alcohols or amines gives a final product that also contains residual chlorine. This residual chlorine may cause deleterious effects in certain formulations or in certain applications.

Additionally, due to environmental concerns, it has now become desirable to eliminate or reduce the level of chlorine. One potential solution to eliminating the chlorine contained in lubricant and fuel additives is simply not to use chlorine in the manufacturing process. Another potential solution is to develop procedures for treating such compositions to remove the chlorine which is present. One procedure for treating various chlorine-containing organic compounds to reduce the level of chlorine therein is described in a European patent application published under Publication No. 655,242. The procedure described therein for reducing the chlorine content of organochlorine compounds comprises introducing a source of iodine into the organochlorine compound and contacting the components of the resulting mixture for a sufficient amount of time to reduce the chlorine content without substantially incorporating iodine or bromine into the organochlorine compound. This procedure is successful in reducing the chlorine content of organochlorine compounds, but, in some instances, it is desirable to further reduce the amount of chlorine in additive compositions which are to be utilized in lubricants and fuels.

One technique for reducing the amount of chlorine in additive compositions based on polyalkenyl-substituted dicarboxylic acids is to prepare such hydrocarbon-substituted dicarboxylic acids in the absence of chlorine, and procedures have been described for preparing such compounds by the "Thermal" process in which the polyolefin and the unsaturated dicarboxylic acid are heated together, optimally in the presence of a catalyst. However, when this procedure is used, it is more difficult to incorporate an excess of the succinic groups into the polyalkenyl-substituted succinic acylating agents, and dispersants prepared from such acylating agents do not exhibit sufficient viscosity index improving characteristics.

The preparation of dispersants low in chlorine which are useful in this invention relates primarily to a unique method of reacting conventional polyolefins with halogen. The halogen used is limited to only an amount up to that necessary to haloginate specific olefinic end groups in the polyolefin. This dispersant relates to methods of halogenating terminal tetra-substituted, and tri-substituted groups of polyolefins. The halogen incorporated by reacting with these groups is labile in that much of it is removed during subsequent reacting of the polyolefins. The labile halogen is thought to be in the form of allylic halides which, when reacted with $\alpha$, $\beta$-unsaturated compounds, form polyolefin-substituted carboxylic acylating agents having a low halogen content of less than about 1000 ppm down to less than 200 ppm or even 100 ppm. Further reacting of the polyolefin-substituted acylating agent with (a) amines and polyamines having at least one >N—H group, or (b) hydroxy-amino compounds, yield nitrogen containing dispersants all described as dispersant reaction products having halogen contents of less than about 1000 ppm. For dispersants formed from polyamines and the acylating agent, the halogen content is less than about 1000 pm and preferably less than about 200 ppm. A full discussion of reaction of polyalknyl-substituted carboxylic acylating agents appears both above and below in this specification. The chlorine values for reaction products (a) and (b) above, with the substituted carboxylic acylating agents are based on the reaction product having an oil content of about 50 percent. The oil content may be in the range of 40–60 percent or even a wider range may be used. Thus on an oil-free basis, the reaction products of (a) and (b) with the acylating agents are roughly the same as for the acylating agent itself. That is, for the reaction products of (a) and (b) with the polyolefin-substituted reaction products the halogen content of the dispersant products is nominally 1000 ppm down to 500 ppm or even 100 ppm or less. The chlorine or halogen content of the polyolefin-substituted carboxylic acylating agents and the dispersants formed therefrom are on an oil-free basis.

The polyolefin used for the low chlorine dispersant derived from polymerized $C_2$–$C_6$ mono olefins and are called conventional polyolefins as opposed to high vinylidene polyolefins. The polymers may be homopolymers or terpolymers. The preferred polyolefin is polyisobutene (PEB) formed by polymerizing the $C_4$-raffinate of a cat cracker or ethylene plant butane/butene stream using aluminum chloride or other acid catalyst systems.

The $\overline{Mn}$ range of the polyolefins is from about 300–10,000 or even up to 50,000. However, for instance, the preferred range for polybutenes is $\overline{Mn}$ of about 300–5,000 and the most preferred upper limit $\overline{Mn}$ is in the range of about $\overline{Mn}$ 300–2,500.

The polyolefin made in this manner is termed a conventional polybutene or polyisobutene and is characterized by having unsaturated end groups shown in Table 1 with estimates of their mole percents based on moles of polybutenes. The structures are as shown in EPO 355 895.

The isomers shown in Table 1 for conventional polyisobutene and their amounts were determined from $^{13}C$ NMR spectra made using a Burker AMX500 or 300 instrument and UXNMRP software to work up the spectra which were determined in $CDCl_3$ at 75.4 or 125.7 MHz. Table 2 gives band assignments for isomers XIII, XV and XVI in Table 1. Disappearance of bands XV and XVI is correlated with halogenation carried out in this invention. The solvent used was $CDCl_3$ and the band assignments are shifts from TMS for spectra recorded in a 300 MHz instrument.

TABLE 1

| PIB Terminal Groups | | Percent in Conventional PIB | Percent in High Vinylidene PIB |
|---|---|---|---|
| 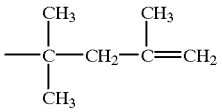 | XIII | 4–5% | 50–90% |
| 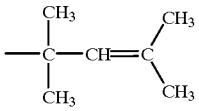 | XIV | isomerizable to XIII | 6–35% |
| 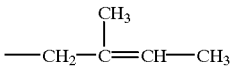 | XV | 63–67% tri-substituted | absent or minor |
| 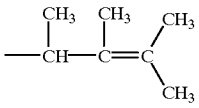 | XVI | 22–28% tetrasubstituted | 1–15% |
| 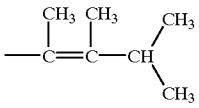 | XVIa | | |
| 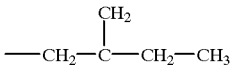 | XVII | 5–8% | 0–4% |
| Other | | 0–10% | |

TABLE 2

| Isomer From Table 1 | $^{13}$CNMR BANDS |
|---|---|
| XIII | 143.5, 114.7 ppm |
| XV | 133.7, 122.9 ppm<br>134.4, 122.6 ppm |
| XVI | 121.5, 133.5 ppm |

Conventional polybutenes of this dispersant have a total of roughly about 80–90 mole percent tri and tetrasubstituted unsaturated end groups (XV and XVI in Table 1) are reacted with halogen to form halogenated polybutenes. The amount of halogen used is limited to up to that which is necessary to halogenate the tri and tetrasubstituted end groups. An excess over that amount of halogen will result in overhalogenation of the polybutene and reaction products obtained therefrom will not be useful in compositions requiring low halogen content. Halogenation of the tri and tetrasubstituted end groups results in partially halogenated polybutene. The halogen in the partially halogenated products is labile and is lost in further reaction of the halogenated product with the α-βunsaturated compounds. Specific halogenation of the tri and tetrasubstituted end group is controlled by reaction conditions, the amount of halogen used, solvent and temperature.

Under selected reaction conditions, the trisubstituted end group XV is halogenated but this has been found to occur at a lower rate constant than tetra halogenation. The vinylidene isomer XIII is by and large not subject to halogenation under selected reaction conditions. Further, the polyolefin backbone is not chlorinated or is only little chlorinated under reaction conditions selected to halogenate the tetra and trisubstituted end groups. By forming labile allylic halogens in the polyolefin rather than backbone halogens low halogen content products may be made from the partially and selectively halogenated polyolefins. Lack of halogen in the polyolefin backbone is of great importance for the production of low chlorine reaction products since this halogen is difficult to remove and remains with the products. While intractable halogen is identified as being on the polymer backbone, other types of chlorine may be involved.

In the partial chlorination step most of the tetrasubstituted isomer XVI can be converted to allylic chlorides. The trisubstituted isomer XV is converted at a slower rate and the vinylidene XIII isomers olefins remain mainly wireacted. In a classical direct alkylation process, the tetrasubstituted olefin end groups react sluggishly, if at all, due to steric inhibition in the ene reaction while the less hindered vinylidene and trisubstituted olefin end groups react at better rates. However, partially chlorinated polybutene is highly reactive in the direct alkylation process because the allylic chlorides undergo dehydrochlorination to dienes followed by Diels-Alder reaction with maleic anhydride to give Diels-Alder type polybutene succinic anhydrides. As the direct alkylation proceeds, the unreacted trisubstituted and vinylidene olefins isomers XIII and XV are converted to polybutene-substituted succinic anhydrides via ene reactions. Early generation of the Diels-Alder type polybutene-substituted succinic anhydrides, which help solubilize maleic anhydride in the reaction media, might facilitate the later ene reactions. Operation of the two complimentary succination processes affords good conversion to the polyolefin substituted acylating agent. The carboxylic acylating agents or succinic compounds so formed are lower in halogen than any previously isolated in halogen promoted reaction of polyolefins and α-βunsaturated acids. It is a feature of this invention that polyolefin-substituted succinic anhydrides have a halogen content of less than 1000 parts per million halogen and even less than about 200 parts per million halogen.

In addition to the chlorine to polyolefin end groups ratio, the temperature at which the chlorination reaction is conducted is also of great importance. The preferred temperature range for conducting the chlorination of conventional polyolefins is between 50–190° C. It is even more preferred to conduct the reaction at a temperature from 40° C. to 80° C. if substantially chlorine inert solvents such as hexanes are used.

Another important aspect of the polyolefin chlorination reaction is that it can be conducted in the presence of a solvent. Further in this invention, the reaction for the formation of the alkyl-substituted succinic anhydrides may be run as a one-step reaction for the formation of the alkyl-substituted succinic anhydrides with the polyolefin, halogen and α-β unsaturated acid being reacted at the same time. A further aspect of this invention is that the halogen may be diluted with an inert gas. Also, by following this invention less residual polyolefin results than in direct alkylation synthesis of substituted carboxylic acylating agents.

Experimental Polyolefin Halogenation and Reaction with ad Unsaturated Anhydrides Conventional polybutenes are commercially available from Lubrizol, British Petroleum, Amoco and Exxon under various trade names. The products are available in a range of molecular weights. Alternatively, a conventional PE3 may be synthesized from isobutylene and $AlCl_3$. In this synthesis, 2.6 moles isobutylene was added to 0.0295 moles of aluminum chloride being stilted in hexane under nitrogen in a −40° C. bath. Isobutylene was cooled to −78° C. with dry ice/isopropanol and added dropwise to the $AlCl_3$. Following addition which is exothermic, the reaction mixture was poured into a beaker containing a 7% sodium hydroxide solution. The organic layer was separated, washed with aqueous sodium chloride solution and stripped on an evaporator at 100° C. under reduced pressure.

It has been found that if the polyolefin halogenation reaction is correlated with the tri and tetrasubstituted unsaturated end groups, and the maximum amount of halogen is limited in use only up to that amount of halogen which is necessary to halogenate the tetrasubstituted and trisubstituted unsaturated end groups, then a polyolefin such as polyisobutene having low and labile halogen content results. Since the halogen content of the polyolefin is low and mainly labile and then compounds made from this will necessarily be of low halogen content considering that halogen is replaced by said α-β unsaturated compound in subsequent reactions.

In Table 3, data is presented for the partial chlorination of conventional polyisobutenes, and the subsequent reaction products of the halogenated polyisobutenes with maleic anhydride.

TABLE 3

A. Reaction of a $\overline{Mn}$ 1000 conventional polyisobutene (PIB) with chlorine at 65–70° C. in 20% weight/weight hexane to form a chlorinated PIB (PEB-Cl), followed by reaction of the chlorinated PEB with 2.5 moles of maleic anhydride per mole of chlorinated PEB for 24 hours at 200° C. to produce a PIB-succinic anhydride.

| Moles $Cl_2$ per Mole of PIB | ppm Cl in PIB-Cl | ppm Cl in PIB-succinic anhydride |
|---|---|---|
| 0.2 | 6,740 | 141 |
| 0.3 | 10,500 | 190 |
| 0.4 | 12,680 | 195 |
| 0.5 | 15,900 | 276 |

B. Same as A except PIB $\overline{Mn}$ is 2000, concentration of PIB is 45% weight/weight hexane and 3.0 moles of maleic anhydride were used and a bromine sample included.

| Moles $Cl_2$ per Mole of PIB | ppm Cl in PIB-Cl | ppm Cl in PIB-succinic anhydride |
|---|---|---|
| 0.32 | 4,450 | 84 |
| 0.4 | 6,290 | 121 |
| 0.5 | 7,790 | 183 |
| 0.64 | 10,090 | 234 |
| 0.93 | 13,840 | 413 |
| 1.2 | — | 1,022 |
| 0.4 (bromine) | 22,900 (bromine) | 85 (bromine) |

C. Reaction of $\overline{Mn}$ 2000 PIB with chlorine without the use of solvent

| Moles $Cl_2$ per Mole of PIB | ppm Cl in PIB-succinic anhydride |
|---|---|
| 1. 0.3 | 234 |
| 2. 0.43 | 426 |
| 3. 0.55 | 700 |
| 4. 0.75 | 998 |
| 5. 1.2 | 5,350 |

Reaction conditions:

C.1. Partial chlorination at 150° C. followed by reaction with maleic anhydride at 200° C. for 24 hours, 3 moles maleic anhydride per mole of starting PIB.

C.2. Single reaction with PIB, chlorine, maleic anhydride present during chlorination at 130° C., temperature raised to 205° C. for 8 hours, 2.2 moles maleic anhydride/mole of starting PIB.

C.3. Single reaction with PIB, chlorine, maleic anhydride present during chlorination over 8 hours at 138–190° C., temperature raised to 220° C. for 6 hours, 1.12 moles of maleic anhydride per mole of starting PIB.

C.4. Single reaction with PIB, chlorine, maleic anhydride being present during chlorination over 8 hours at 130–190° C., temperature raised to 204° C. for 8 hours and 216° C. for 6 hours. The mole ratio of maleic anhydride to PIB was 1.12:1.

C.5. Conventional one step process reaction.

Table 3 illustrates that influenced by solvent and temperature, there is a shift from low chlorine containing polyalkenyl succinic acylating agents having chlorine in ppm from about 500 up to about 1000 to high chlorine level acylating agents having chlorine contents of around 5000 ppm. These results illustrate that at some stage in the chlorination reaction there is a shift in which non-labile halogen is incorporated into the polyisobutene. These results are graphically illustrated in FIG. 2 which represent the data of Table B, the chlorination of a PIB Mn 2000 in hexane.

EXAMPLE A-22

A preferred method of carrying out this invention is to mix together with heating 6000 grams $\overline{Mn}$ 2000 polyisobutylene (3 moles), maleic anhydride 329 grams (3.36 moles) and chlorine 117 grams (1.65 moles) in the following manner to make a PIB-succinic anhydride. The polymer and anhydride were mixed and heated to 138° C. Chlorine was added at the rate of 15.4 grams per hour over 6.5 hours and then at 11.3 grams per hour for 1.5 hours. The temperature was raised linearly from 138° C. –190° C. during the 8 hours of the chlorine addition.

Following chlorination, the mixture was heated to 220° C. and held for four hours. Nitrogen gas was blown through the mixture at 220° C. for the final two hours. The PIB-succinic anhydride formed in this reaction has a chlorine content of 0.070% weight or 700 parts per million.

The 700 ppm chlorine polyisobutylene substituted succinic anhydride made above was further reacted with an amines bottom product to form a dispersant. The amines, 204.3 grams (5.07 equivalents) were added to a mixture of 4267 grams of a 100 SN oil and 4097 grams (3.9 equivalents) of the 700 ppm chlorine PD3-succinic anhydride over 1 hour. The amine addition is done at 110° C. The mixture was kept at 110° C. for 0.5 hours with nitrogen blowing through at 0.1 cu ft/hour. The mixture was then heated to 155° C. over 0.75 hours and kept at 155° C. for 5 hours while water was distilled off. FAX-5 filter aid (138 grams) was added to the mixture and after 0.25 hours at 155° C., the mixture was filtered through a filter cloth to give the dispersant with a chlorine content of 311 ppm and an oil content of 50%.

It should be recognized that while chlorine up to about 0.9 moles of chlorine/mole of conventional PIB may be used in this invention depending upon the tetra- and trisubstituted end groups, lesser amounts up to this maximum of 0–9 moles may also be used. In reacting the partially chlorinated polyisobutylene with maleic anhydride, mole ratios of 0.5–5 to 1 for anhydride to polyisobutylene may be used. Also, for reacting the low halogen polyisobutylene succinic anhydride with amines, alcohols and metal-containing compounds to form dispersants, esters and metal derivatives of the PEB-succinic anhydrides, a wide range of ratios for the reactants with the low chlorine containing PIB-succinic anhydride acylating agent may be used. The mole ratios of acylating agent to reactant can be from 10:1 to 1:10. It is preferred that the PEB-succinic anhydride be thoroughly succinated.

A further method of carrying out this invention is to use a diluent gas during the chlorination reaction. Useful gases are $CO_2$, $N_2$, and $N_2O$. The use of the gases resulted in PEB-succinic anhydrides having lower chlorine content than when chlorine is used alone. A standard reaction with no dilution gas was run wherein a mixture of one mole of conventional $\overline{Mn}$ 2000 polyisobutylene treated with 0.31 moles of chlorine was reacted in the presence of 2.2 moles of maleic anhydride. The PIB and anhydride were heated at 138° C. and the temperature ramped to 190° C. over a seven hour period. The chlorine was added over the first three hours (temperature at end 160° C.). The mixture was kept at 200° C. for 24 hours then stripped. This yielded a PIB-succinic anhydride with 293 ppm chlorine.

When a dilution gas was used, the gas was added at the rate of 0.1–0.2 standard cubic foot per hour over the whole time of reaction. Use of the three gases listed above gave ppm chlorine value PIB-succinic anhydrides of $CO_2$—179, $N_2O$—181, $N_2$— 218. This demonstrates the utility of using a dilution gas in the reaction process. When 1.2 moles of chlorine were used per mole of PIB, the PIB succinic anhydride chlorine content from halogenation in hexane is 1022 ppm (Table 3B) while that from halogenation without solvent (Table 2C) is 5350. The higher chlorine level in the solvent-free chlorination reaction is attributable to polymer backbone halogenation which becomes more predominant at the higher temperatures used in solvent-free halogenation.

The main point of the data in Table 3 is that if the maximum amount of halogen used in the halogenation reaction of the polyolefin is limited in amount up to that which is necessary to halogenate the tri and tetrasubstituted end group of the polyolefin, then PIB-succinic anhydrides result from these polyolefins which are low in chlorine and which may be used in compositions having low halogen requirements. Amounts of halogen lower than the maximum are, of course, also useful as is shown in Table 3. Use of halogen beyond this amount results in non-labile halogen being incorporated with the polyisobutene. Table 3 indicates that at a value of about 0.9 moles of chlorine per mole of PIB, largely halogenation of the tri and tetrasubstituted end groups takes place. This value corresponds to the tri and tetrasubstituted end group mole percent in the PIB. If one correlates halogen addition to the PIB with the tri and tetrasubstituted end groups then low halogen content PIBs result. This means, of course, that the derivatives made from these PIBs such as PIB-succinic anhydrides and reaction products of PIB-succinic anhydrides such as dispersants and metal salts will also be low in halogen and thus be usable in compositions having low halogen requirements. The useful range of halogen used to halogenate the polyisobutylene then ranges over value up to about 0.9 moles of chlorine per mole of PBU. Additional low chlorine dispersants are prepared according to the following procedures.

Example A-23 Following essentially the same procedure of Example A-22, 1000 grams of the polyisobutene is reacted with a total of 106 grams maleic anhydride and a total of 90 grams chlorine. After obtaining the anhydride, 1000 parts of it is treated with 4 parts of iodine which lowers the chlorine content to 0.1 percent. This low chlorinated anhydride is diluted with 667 grams of diluent oil. Following the succinimide disclosure of Example A-22, 1000 grams of the low chlorinated oil diluted polyisobutenyl anhydride is further diluted with 337 grams of diluent oil and the mixture is reacted with 32 grams of a polyamine bottoms product to form a dispersant. Additional oil, 25 grams, is added to give a low chlorinated dispersant with a 55 percent oil content.

EXAMPLE A-24

Reacted together are 1000 grams of PIBSA (a low chlorine, about 50 ppm, available from Texaco Additive Company), 398 grams diluent oil and 42.2 grams of polyamines (nitrogen content of 34 percent). The temperature is increased to 154° C. with nitrogen sweeping through the reactor for one hour. An additional 30 grams oil is added and the contents are filtered to give a product containing 40% oil, 0.97 nitrogen and 14 total base number.

Olefin—Carboxylic Acid/Carboxylate Dispersant

This dispersant is prepared by a process comprising reacting, usually in the presence of an acidic catalyst, more than 1.5 moles, preferably from about 1.6 to about 3 moles of at least one carboxylic reactant per equivalent of at least one olefinic compound wherein and are defined in greater detail hereinbelow.

All of the reactants may be present at the same time. It has been found that improvements in yield and purity of product are sometimes attained when the carboxylic reactant is added portionwise over an extended period of time, usually up to about 10 hours, more often from 1 hour up to about 6 hours, frequently from about 2–4 hours. However, it is generally preferred to have all of the reactants present at the outset. Water is removed during reaction. Optionally the process for this dispersant may be conducted in the presence of a solvent. Well known solvents include aromatic and aliphatic solvents, oil, etc. When a solvent is used, the mode of combining reactants does not appear to have any effect.

The process of this dispersant is optionally conducted in the presence of an acidic catalyst. Acid catalysts, such as organic sulfonic acids, for example, paratoluene sulfonic acid and methane sulfonic acid, heteropolyacids, the complex acids of heavy metals (e.g., Mo, W, Sn, V, Zr, etc.) with phosphoric acids (e.g., phosphomolybdic acid), and mineral acids, for example, $H_2SO_4$ and phosphoric acid, are useful. The amount of catalyst used is generally small, ranging from about 0.01 mole % to about 10 mole %, more often from about 0.1 mole % to about 2 mole %, based on moles of olefinic reactant.

Methods for preparing this type of dispersant are well known in the art and need not be illustrated in farther detail here. For example, see U.S. Pat. No. 5,739,356, which is hereby incorporated by reference for its disclosure of the preparation of this dispersant.

The dispersant compositions, as above-described, may be boron post-treated by contacting the dispersant composition with one or more boron sources selected from the group consisting of boron acids, boron oxide, boron oxide hydrates, boron halides, and esters of boron acids.

(B) The Sludge Preventing/Seal Protecting Additive

In order to complete the composition of this invention, an amount of at least one aldehyde or epoxide or mixtures thereof is employed.

It is known that as nitrogen containing dispersants decay or degrade, amines are formed. This formation of a free amine causes a deleterious effect either by reacting with other components that are present such that sludge is formed, or by reacting with (attacking) the viton seals to degrade these seals. While not wishing to be bound by theory, the sludge preventer/and seal protectors are believed to react with the amines to render the amines innocuous. It is believed aldehydes react with amines according to the following two equations.

$$R^xCHO+R^yNH_2 \rightarrow R^xCH{=}NR^y \qquad \text{(Schiff base)}$$

The resulting Schiff base probably reacts with another mole of amine to form the following product:

$$R^xCH{=}NHR^y+R^yNH_2 \rightarrow R^xCH(NHR^y)_2$$

It is believed that epoxides react with amines according to the following two equations

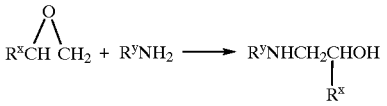

-continued

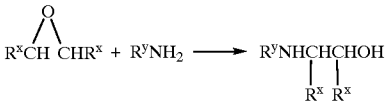

The Aldehyde

The aldehyde as a sludge preventing/seal protecting additive is an aromatic aldehyde. As aromatic aldehydes, the aldehyde contains a substituted phelnyl group. The substitutent groups may be hydroxy, alkyl, alkoxy, and also combinations of hydroxy and alkyl or hydroxy and alkoxy. Preferred aromatic aldehydes are

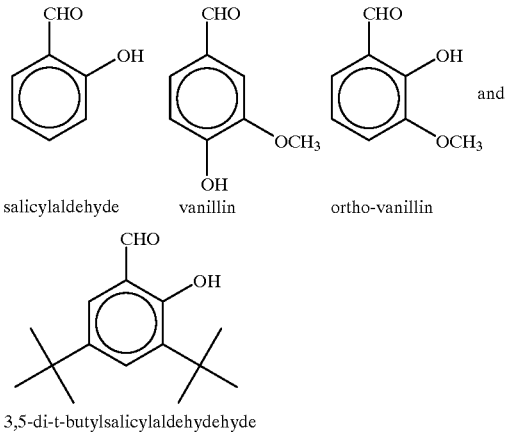

Especially preferred aromatic aldehydes are 3,5-di-t-butylsalicylaldehyde and ortho-vanillin.

The Epoxides

The epoxides having utility in this invention contain at least one oxirane ring. The oxirane ring may be a terminal oxirane ring or an internal oxirane ring. In order for an oxirane ring to be a terminal oxirane ring, one of the carbon atoms to which the oxirane oxygen is attached must contain two hydrogen atoms. In order for an oxirane ring to be an internal oxirane ring, neither of the carbon atoms to which the oxirane oxygen is attached can contain more than one hydrogen atom.

A terminal oxirane ring is of the structure

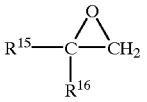

wherein $R^{15}$ is a hydrocarbyl group containing from 1 to 100 carbon atoms and $R^{16}$ is hydrogen or an alkyl group containing from 1 to 4 carbon atoms. In a preferred embodiment, $R^{15}$ is an alkyl group containing from 1 to 40 carbon atoms and R is hydrogen. In a most preferred embodiment, $R^{15}$ contains 14 carbon atoms and $R^{16}$ is hydrogen. This epoxide is hexadecylene oxide. In another preferred epoxide, $R^{15}$ is an alkyl group containing from 8 to 50 carbon atoms and $R^{16}$ is a methyl group. As a hydrocarbyl group, $R^{15}$ may contain a heteroatom as in $R^{18}OCH_2$— wherein $R^{18}$ is an alkyl group containing from 1 to 18 carbon atoms. In yet another preferred epoxide, $R^{15}$ is

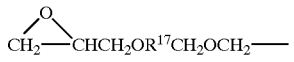

wherein $R^{17}$ contains from 1 to 12 carbon atoms. With this epoxide, two oxirane rings are present as well as an ether linkage. This is an example of diglycidyl ether. Diglycidyl ethers of this type can be obtained from Shell Chemical as, for example, Heloxy® Modifier 67, a diglycidyl ether of 1,4 butanediol and Heloxy® Modifier 68, a diglycidyl ether of neopentyl glycol.

Limonene dioxide functions both as a terminal epoxide and an internal epoxide.

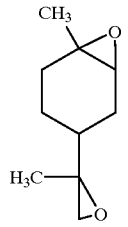

limonene dioxide

Epoxides having utility in this invention can also contain at least one internal oxirane ring. Useful internal oxiranes are of the formula

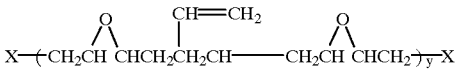

wherein X is independently —H or —OH and y is an integer of from 2 to 6. This epoxide is available from Elf Atochem as a hydroxy or hydrogen terminated 3% or 6% oxirane content, respectively, as an epoxidized polybutadiene. Another internal oxirane is of the structure

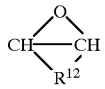

wherein $R^{12}$ is an alkylene group containing 3 or 4 carbon atoms. Other internal epoxides are

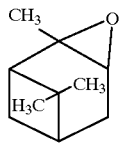

alpha pinene oxide and

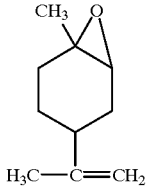

limonene monoxide

As noted above, limonene dioxide is also an internal epoxide.

The epoxide can also be a vegetable oil epoxide or an ester of a vegetable oil epoxide. Both of these epoxide types are available from Elf Atochem in the Vikoflex® series. Vikoflex® 7170 and Vikoflex® 7190 are epoxidized soybean oil and epoxidized linseed oil, respectively. As an ester of a vegetable oil epoxide, the ester group contains from 1 to 8 carbon atoms. Representative examples of esters of vegetable oil epoxides are Vikoflex® 7010, a methyl ester of epoxidized soybean oil, Vikoflex® 9010, a methyl ester of epoxidized linseed oil, Vikoflex® 7040 and Vikoflex® 9040, butyl esters of epoxidized soybean oil and epoxidized linseed oil, respectively and Vikoflex® 7080 and Vikoflex® 9080, 2-ethylhexyl esters of epoxidized soybean oil and epoxidized linseed oil, respectively.

The composition of this invention comprises an admixture of components (A) and (B). For every 100 parts of (A) that are employed, there are generally 2–75 parts of (B) present, preferably from 3–60 parts of (B) and most preferably from 5–50 parts of (B). Order of addition is of no consequence. Component (A) can be added to Component (B) or Component (B) can be added to Component (A). Additionally, other components can be present within either (A) or (B) when the admixture is carried out. Further component (B) can be added to component (A) as a top-treatment to a final crankcase blend or added to a concentrate during typical blending conditions. Preferably components (A) and (B) are mixed together followed by the addition of other components.

To establish the efficacy of this invention, the inventive composition of components (A) and (B) along with other components are blended together to give an inventive test formulation. This inventive test formulation is measured against a baseline formulation. The baseline formulation contains all the components of the test formulation but for component (B). Both the inventive test formulation and the baseline formulation are considered to be fully formulated crankcase oils. These formulations are evaluated in a sludge screen test to determine the ability not to produce sludge. Screen tests are used in lieu of conducting a full engine test evaluation. Reliable screen tests are a valid predictor of engine performance.

To a test tube containing a formulation is added a fuel and an inorganic acid. The contents are mixed at room temperature for about one minute. The test tube containing the contents is then placed in a heated bath. Air and $NO_x$ are bubbled into the contents. After several hours, a catalyst is added to the contents.

A drop of the test blend is spotted onto chromatographic paper which is then stored in a heated oven and then removed from the oven for the remainder of the test evaluation. The original spot continues to spread over time becoming larger in diameter. In many instances, an inner spot begins to form. A ratio of the diameter of the small spot:diameter of the large spot is determined at specific test hours. The ratio is expressed as a percent. A high ratio (greater than 50 percent) represents a formulation with low sludge and a low ratio (less than 50 percent) represents a formulation with high sludge. The test is stopped and evaluated under two conditions:

1. When the ratio is at 50 percent, the total hours to achieve 50 percent becomes the test value, or
2. When the ratio is above 50 percent for the duration of the test, which is 122 hours, the test value then is 122 hours.

In the examples of the following table, Examples 1–4 are to be compared to Baseline A, the baseline for Examples 1–4. Examples 5–7 are to be compared to Baseline B, the baseline for Examples 5–7.

Sludge Test

| Example | Oil | (A) | (B) | Hours to Fail |
|---|---|---|---|---|
| A | 103 parts | 3.85 parts product of Example A-23; 0.66 parts product of Example A-24 | None | 73 |
| 1 | 103 parts | 3.85 parts product of Example A-23; 0.66 parts product of Example A-24 | 0.25 parts o-vanillin | 122 |
| 2 | 103 parts | 3.85 parts product of Example A-23; 0.66 parts product of Example A-24 | 0.25 parts hexadecylene oxide | 121 |
| 3 | 103 parts | 3.85 parts product of Example A-23; 0.66 parts product of Example A-24 | 0.5 parts hexadecylene oxide | 122 |
| 4 | 103 parts | 3.85 parts product of Example A-23; 0.66 parts product of Example A-24 | 1.0 part hexadecylene oxide | 122 |
| B | 111 parts | 2.2 parts product of Example A-23 | None | <67 |
| 5 | 111 parts | 2.2 parts product of Example A-23 | 0.25 parts o-vanillin | 78 |
| 6 | 111 parts | 2.2 parts product of Example A-23 | 0.25 parts hexadecylene oxide | 91 |
| 7 | 111 parts | 2.2 parts product of Example A-23 | 1.0 part hexadecylene oxide | 91 |

A higher test value hours indicates a more desirable performance.

The inventive composition of this invention is also evaluated in the Volkswagon PV 3344 Viton Seal Test. This test is designed to test the compatibility of a crankcase lubricating oil that contains a nitrogen-containing dispersant. The elastomer to be tested is the Parker-Pradifa SRE AK6, which also has the designation FKM E-281. Prior to the test the elastomer specimens are thermally conditioned at 150° C. for a period of 48 hours. The purpose of this conditioning is to drive off moisture which is readily absorbed by the filler component of this elastomer.

As described in the sludge test above, the inventive composition of components (A) and (B) along with other components are blended together to give an inventive test formulation. Thermally conditioned specimens are immersed into the test formulation wherein the volume of the formulation: volume of the elastomer is approximately 85.1. The immersion test temperature is 150° C. and the immersion period is a total of 282 hours made up of three 94-hour periods. After the first two 94-hour periods, the test formulation is replaced with a fresh test formulation. At the completion of the 282-hour period, the elastomer specimens are evaluated for tensile strength, elongation and cracking. In order to pass this test, the tensile strength must be at least 8 Newtons per square millimeter; the rupture elongation must be at least 160 percent, and there can be no evidence of cracking.

In the examples of the following table, Example 8 is to be compared to Example C, the baseline for Example 8.

Viton Seal Compatibility Test

| Example | Oil | (A) | (B) | Tensile Strength | Elongation | Cracking |
|---|---|---|---|---|---|---|
| C | 92 Parts | 7 Parts Product of Example A-22 | None | 6.7 | 153 | Yes |
| 8 | 92 Parts | 7 Parts Product of Example A-22 | 1,4-butanediol diglycidyl ether | 10.9 | 223 | No |

While the invention has been explained in relation to its preferred embodiments, it is to be understood that various modifications thereof will become apparent to those skilled in the art upon reading the disclosure. Therefore, it is to be understood that the invention disclosed herein is intended to cover such modifications as fall within the scope of the appended claims.

What is claimed is:

1. A lubricating composition for internal combustion engines, suitable for providing reduced seal deterioration and reduced sludge production, said lubricating composition comprising a major amount of an oil of lubrication viscosity and a minor amount of an admixture consisting of (A) a nitrogen-containing dispersant with a total base number of from 30 to 160 on an oil-free basis, said nitrogen-containing dispersant being selected from the group consisting of (1) Mannich reaction products of at least one phenol containing at least one aliphatic substituent with formaldehyde and an amino compound and (2) reaction products of hydrocarbyl-substituted succinic acylating agents, said hydrocarbyl group having a number average molecular weight of at least about 300, and at least one of (a) ammonia or (b) an amine; and (B) a sludge preventing/seal protecting additive of at least one aromatic aldehyde, or epoxide containing a terminal oxirane ring, or mixtures thereof;

provided that components (A) and (B) are mixed together followed by addition of other components.

2. The composition of claim 1 wherein the dispersant is a Mannich reaction product of at least one phenol containing at least one aliphatic substituent with formaldehyde and an amino compound wherein the dispersant has a total base number of at least 40 on an oil-free basis.

3. The composition of claim 2 wherein the amino compound is an alkylene polyamine.

4. The composition of claim 1 wherein the dispersant is a reaction product of a hydrocarbyl-substituted succinic acylating agent, and at least one of (a) ammonia, or (b) an amine.

5. The composition of claim 4 wherein the hydrocarbyl group contains an average of from about 40 to about 500 carbon atoms.

6. The composition of claim 4 wherein the hydrocarbyl group is derived from a polyolefin.

7. The composition of claim 4 wherein the hydrocarbyl group is derived from a polyalkene having a number average molecular weight of from about 1500 to about 5000, and wherein the number of equivalents of succinic groups to the number of equivalents of hydrocarbyl groups is at least about 1.3.

8. The composition of claim 4 wherein the hydrocarbyl substituted succinic acylating agent is reacted with an amine comprising a monoamine or a polyamine wherein the dispersant has a total base number of at least 40 on an oil-free basis.

9. The composition of claim 8 wherein the amine comprises monoethanolamine, diethanolamine, triethanolamine, dimethylethanolamine, diethyl-ethanolamine, dimethylaminopropanol, diethylaminopropanol, or aminopropanol.

10. The composition of claim 1 wherein the dispersant is prepared from a mixture containing a chlorine containing polyolefin wherein the polyolefin has a molecular weight of Mn 300–10,000 and having a total of tetra-and tri-substituted unsaturated end groups in an amount of up to about 90 mole percent based on the moles of said polyolefin and chlorine wherein said chlorine is present in the mixture on a molar basis up to about an amount equal to the moles of tetra-and tri-substituted end groups and reacting the mixture under time and temperature parameters selected to effect reaction of the polyolefin end groups and chlorine to produce a polyolefin reaction product having labile chlorine substituents and wherein the polyolefin reaction product chlorine content is limited by correlating the amount of halogen reacted to the polyolefin end groups.

11. The composition of claim 10 wherein the dispersant comprises forming a mixture of the chlorine containing polyolefin with an α-β-unsaturated compound, said compound comprising α-β-unsaturated acids, anhydrides, derivatives or mixtures thereof and reacting the mixture under time and temperature parameters selected to effect reaction of the polyolefin with the α-β-unsaturated compound to produce a polyolefin substituted reaction product having low chlorine content, said substituted reaction product comprising a polyolefin substituted acid, anhydride, derivative thereof or mixture thereof having a low chlorine content.

12. The composition of claim 10 wherein said temperature ranges between about 20° C.–175° C.

13. The composition of claim 11, wherein said polyolefin substituted reaction product is a polybutene substituted succinic acid, anhydride or mixture thereof or derivative thereof.

14. The composition of to claims 13, wherein said halogen content of said polyolefin substituted reaction product is 1000 parts per million or less on an oil-free basis.

15. The composition of claim 13, wherein said method further comprises the steps of:

A. forming a mixture of said polyolefin substituted reaction products having low chlorine content and compounds capable of reacting therewith to form dispersants, said compounds including nitrogen containing compounds comprising (a) amines and polyamines having at least one H—N< group, (b) hydroxyamino compound and B. reacting said mixture under time and temperature parameters to form dispersant reaction products having low halogen content.

16. The composition of claim 1 wherein the aromatic aldehyde is a substituted phenyl aldehyde.

17. The composition of claim 1 wherein the aromatic aldehyde is a vanillin, o-vanillin, salicylaldehyde or alkyl substituted salicyladehyde.

18. The composition of claim 17 wherein the aldehyde is vanillin or o-vanillin.

19. The composition of claim 17 wherein the aldehyde is salicyladehyde or 3,5-di-t-butylsalicylaldehyde.

20. The composition of claim 1 wherein at least one internal oxirane ring is present in addition to said terminal oxirane ring.

21. The composition of claim 20 wherein the epoxide is a vegetable oil epoxide.

22. The composition of claim 20 wherein the epoxide is an alkyl ester of a vegetable oil epoxide wherein the alkyl group contains from 1 to 8 carbon atoms.

23. The composition of claim 1 wherein the epoxide is of the formula

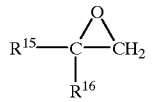

wherein $R^{15}$ is a hydrocarbyl group containing from 1 to 100 carbon atoms and $R^{16}$ is hydrogen or an alkyl group containing from 1 to 4 carbon atoms.

24. The composition of claim 23 wherein $R^{15}$ is an alkyl group containing from 1 to 40 carbon atoms and $R^{16}$ is hydrogen.

25. The composition of claim 23 wherein $R^5$ is an alkyl group containing from 8 to 50 carbon atoms and $R^{16}$ is methyl.

26. The composition of claim 1 wherein the epoxide is of the formula

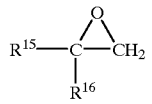

wherein $R^{15}$ is $R^{18}OCH_2$— wherein $R^{18}$ is an alkyl group containing 1 to 18 carbon atoms and $R^{16}$ is hydrogen or an alkyl group containing 1 to 4 carbon atoms.

27. The composition of claim 1 wherein the epoxide is of the formula

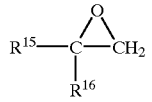

wherein $R^{15}$ is

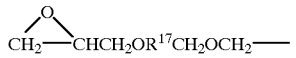

wherein $R^{17}$ contains from 1 to 12 carbon atoms, and $R^{16}$ is hydrogen or an alkyl group containing 1 to 4 carbon atoms.

* * * * *